US007431278B2

(12) United States Patent
Hiraki et al.

(10) Patent No.: US 7,431,278 B2
(45) Date of Patent: Oct. 7, 2008

(54) IMAGE FORMING APPARATUS AND PLATEN USED THEREIN

(75) Inventors: Nobuo Hiraki, Nagoya (JP); Toshio Sugiura, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 538 days.

(21) Appl. No.: 10/807,257

(22) Filed: Mar. 24, 2004

(65) Prior Publication Data

US 2004/0239742 A1 Dec. 2, 2004

(30) Foreign Application Priority Data

Mar. 26, 2003 (JP) ..... 2003-085197
Mar. 31, 2003 (JP) ..... 2003-093347

(51) Int. Cl.
*B65H 5/22* (2006.01)

(52) U.S. Cl. ..... 271/3.14; 271/272; 271/266; 347/104

(58) Field of Classification Search ..... 271/3.14, 271/272, 266; 347/101, 104, 220; 400/23, 400/44, 48, 636, 636.2, 648
See application file for complete search history.

(56) References Cited

U.S. PATENT DOCUMENTS 6,789,890 B2 * 9/2004 Bruhn et al. ..... 347/104
2004/0066445 A1 * 4/2004 Bruhn ..... 347/104
2006/0250473 A1 * 11/2006 Ishii et al. ..... 347/104

FOREIGN PATENT DOCUMENTS

| | | |
|---|---|---|
| JP | A 2-286340 | 11/1990 |
| JP | A-9-220837 | 8/1997 |
| JP | A-11-157285 | 6/1999 |
| JP | A-2000-86007 | 3/2000 |
| JP | A-2000-158637 | 6/2000 |
| JP | A 2001-213559 | 8/2001 |

* cited by examiner

*Primary Examiner*—David H Bollinger
(74) *Attorney, Agent, or Firm*—Oliff & Berridge, PLC

(57) ABSTRACT

An image forming apparatus includes an image forming unit, a platen, a transporting device, and a suction device. The image forming unit forms an image on one surface of a printing medium. The transporting device transports the printing medium in a transportation direction along the platen while the other surface of the printing medium faces a surface of the platen. The suction device sucks air. The platen includes a plurality of rollers, which are rotatable around rotation axes perpendicular to the transportation direction and protrude from the surface of the platen, and a suction opening which is defined on the surface of the platen and communicates with the suction device.

42 Claims, 17 Drawing Sheets

IMAGE FORMING APPARATUS AND PLATEN USED THEREIN

BACKGROUND OF THE INVENTION

1. Field of the Invention

The present invention relates to an image forming apparatus for forming an image on the paper using an image forming unit such as an ink jet recording head, and a suction-type platen disposed at a position opposed to the image forming unit.

2. Description of the Related Art

Conventionally, in an ink jet recording apparatus for depositing ink ejected from nozzles of an ink jet recording head on a paper to form an image, a platen is disposed opposite to a nozzle face of the recording head. A pair of upstream transportation rollers on the upstream side of transportation (hereinafter simply referred to as the upstream side) and a pair of downstream transportation rollers on the downstream side of transportation (hereinafter simply referred to as the downstream side) are disposed to interpose a platen between them. Thereby, the paper is carried by both the roller pairs, which are intermittently driven to move the paper in the sub scanning direction (step feed). On the other hand, a carriage on which the recording head is mounted is moved in a main scanning direction to form an image for each predetermined area on the paper supported by the platen, while the intermittent movement is stopped.

By the way, when the ink is deposited on the paper from the ink jet recording head, the paper may be stretched and rippled (cockling) between the pair of upstream transportation rollers and the pair of downstream transportation rollers. As a result, a surface of the paper is in contact with the nozzle face to cause the recorded image to be contaminated, resulting in a lower image quality. Before a tip of the paper transported is carried by the pair of downstream transportation rollers, or after a trailing end of the paper is get out of the pair of upstream transportation rollers, if the paper is strongly curled, the leading or trailing edge of the paper is in contact with the nozzle face, resulting in a problem that the paper becomes dirty or the recording head is damaged.

In order to solve the above-mentioned problems, in JP-A-2001-213559, opening portions for paper suction having a rough rectangle shape in plan view are provided at regular intervals in a direction orthogonal to a transportation direction of a paper on a surface of a platen, and a suction unit for sucking air through the opening portions are provided.

SUMMARY OF THE INVENTION

However, in the configuration of JP-A-2001-213559, the surface of the platen is a plane, and if the atmospheric air is sucked, the paper and the platen are contacted face-to-face to increase a load for transporting the paper due to a friction between the paper and the platen, hindering the normal transportation of the paper, resulting in a problem that the image is not appropriately formed on the paper.

A suction-type platen and an image forming apparatus including the platen in which an image is formed excellently are disclosed herewith.

According to an embodiment of the invention, an image forming apparatus includes an image forming unit, a platen, a transporting device, and a suction device. The image forming unit forms an image on one surface of a printing medium. The transporting device transports the printing medium in a transportation direction along the platen while the other surface of the printing medium faces a surface of the platen. The suction device sucks air. The platen includes a plurality of rollers which are rotatable around rotation axes perpendicular to the transportation direction and protrude from the surface of the platen, and a suction opening which is defined on the surface of the platen and communicates with the suction device.

According to the embodiment of the invention, a paper carrier includes a plurality of rib portions, an air flow passage, a plurality of rollers, and a suction opening. The plurality of rib portions protrude from a surface of the paper carrier, extend in parallel to a transportation direction of a printing medium, and are arranged in a direction perpendicular to the transportation direction at a predetermined interval. The air flow passage is defined between the adjacent rib portions, and extends in the transportation direction. The plurality of rollers are disposed in at least one of the rib portions and the air flow passage. The suction opening is defined on the surface of the platen in the air flow passage. A part of each roller protrudes to be closer to a printing-medium side than each rib portion.

DETAILED DESCRIPTION OF THE PREFERRED EMBODIMENTS

First Embodiment

The preferred embodiments of the invention will be described below with reference to the accompanying drawings.

A first embodiment of the invention is applied to a printing portion 3 including an ink jet recording head 2 functioning as an image forming unit in a printer apparatus 1.

Figure 1:
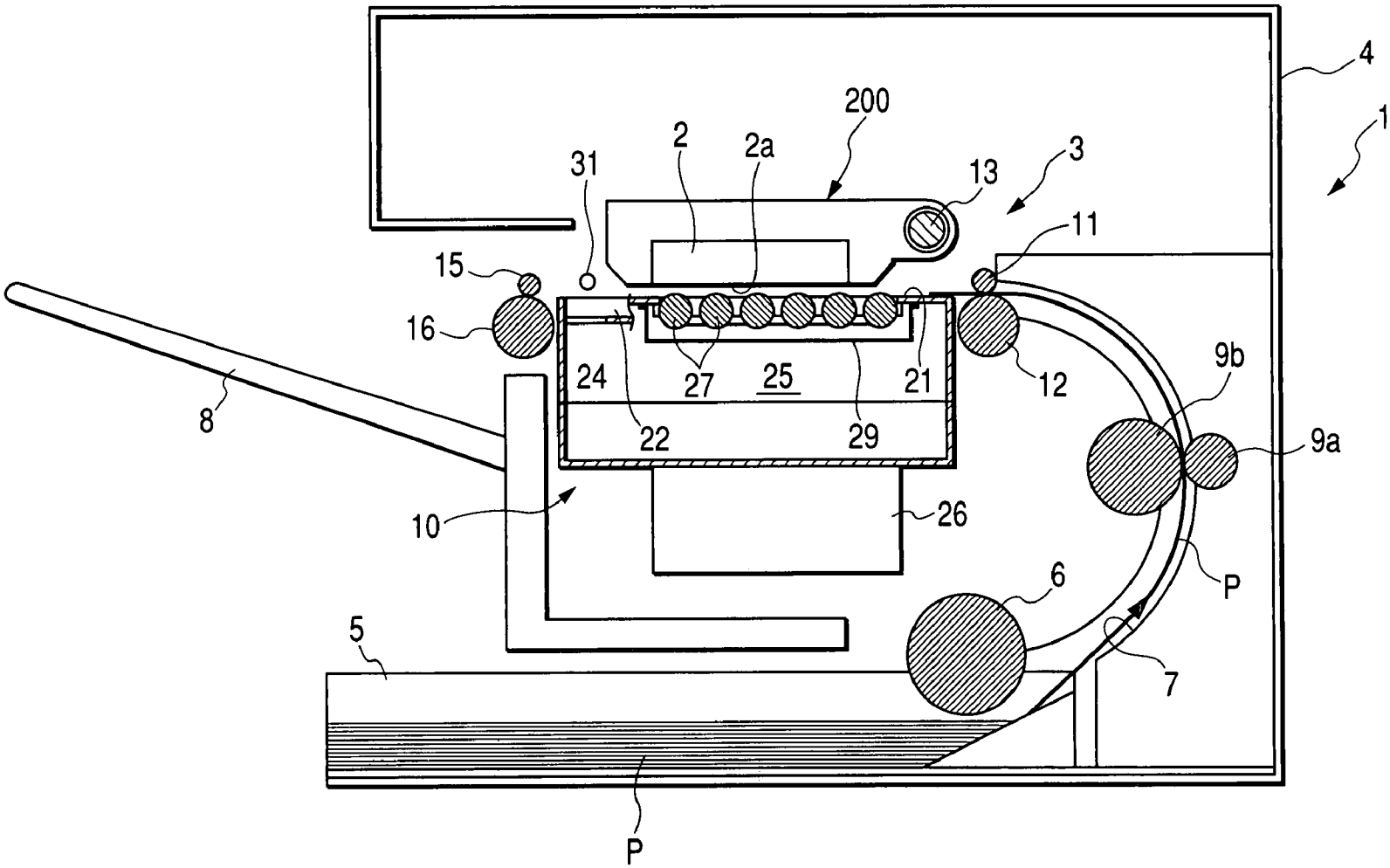
FIG. 1 is a schematic cross-sectional view of a printer apparatus.

As shown in FIG. 1, a paper tray 5 is settled drawably on a bottom of a main body case 4 of the printer apparatus 1. Within the paper tray 5, a pile of paper P is laid on a paper stack (not shown) biased upwardly. When a paper feed roller 6 disposed at a starting position on an upper face of the paper tray 5 rotates, the paper P is separated one by one from the pile of paper P, and transported via a pair of transportation rollers 9*a*, 9*b* disposed in the middle of a transportation path 7 in a direction toward the printing portion 3. A paper outlet tray 8 for receiving the paper P that has an image formed in the printing portion 3 projects sideways from an opening portion on a side face of the main body case 4.

An operation panel portion (not shown) having ten keys for performing a printer operation, a button key for commanding various operations, and a liquid crystal panel is disposed on an upper face of the main body case 4.

The printing portion 3 includes a suction-type platen 10, which will be described later in detail, a pair of upstream transportation rollers 11, 12 disposed on the just upstream side of the platen 10, and a pair of downstream transportation rollers 15, 16 disposed on the just downstream side of the platen 10. The inkjet recording head 2, which is disposed so that a nozzle face 2*a* facing the upper face of the platen 10, is mounted on a carriage 200, which can reciprocate along two guide shafts 13 (only one is shown in the figure) extending longitudinally to left and right. An ink cartridge (not shown) storing ink for each color of cyan, yellow, magenta and black is mounted removably on the upper face of the color inkjet recording head 2 of cartridge type.

The direction of moving the recording head 2 is referred to as a main scanning direction. The direction orthogonal to the main scanning direction is referred to as a sub scanning direction, a direction of transporting the paper, or a transportation direction simply.

A drive roller 16 disposed on the lower side (contact with the unprinted face of the paper P) of the pair of downstream transportation rollers is a single roller rolling in the main scanning direction. Driven rollers 15 on the upper side (contact with the printed face of the paper P) are preferably a spur type ones, and disposed with a predetermined spacing in the main scanning direction.

Figure 2:
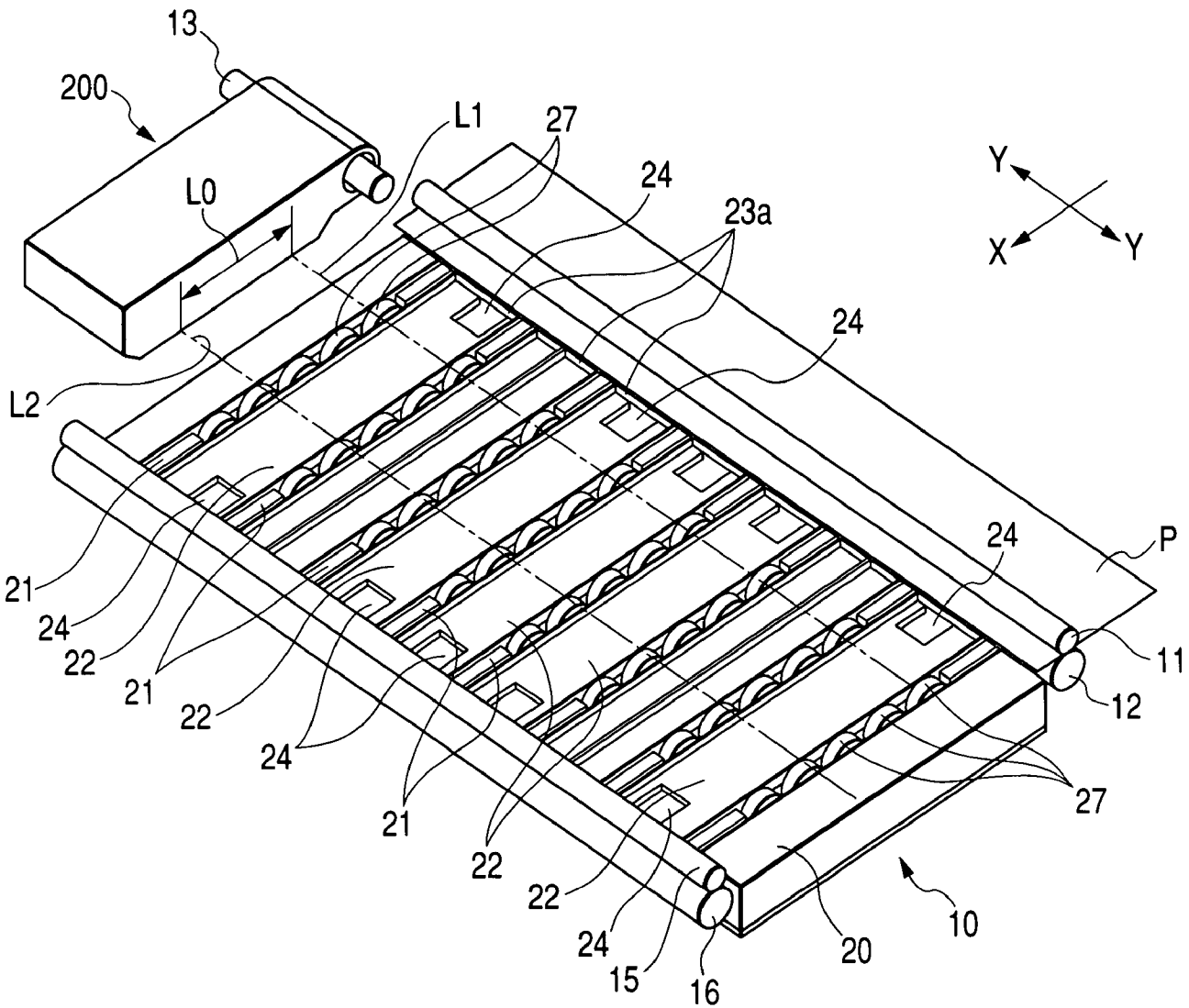
FIG. 2 is a perspective view showing a platen according to a first embodiment of the invention.

As shown in FIG. 2, of the pair of upstream transportation rollers, a drive roller 12 disposed on the lower side is a single roller rolling on the main scanning direction. A driven roller 11 on the upper side is rotatably supported on a top end part of an arm (not shown) for pressing the driven roller 11 against the drive roller 12. The plurality of driven rollers 11 and the arms are disposed with a predetermined spacing in the main scanning direction. An intermediate part of the arm is supported to be movable vertically and rotatably via a support shaft extending in the main scanning direction. The upstream drive roller 12 and the downstream drive roller 16 are rotated synchronously in the same direction intermittently via a transporting motor and a transmission gear mechanism (both not shown).

Figure 3:
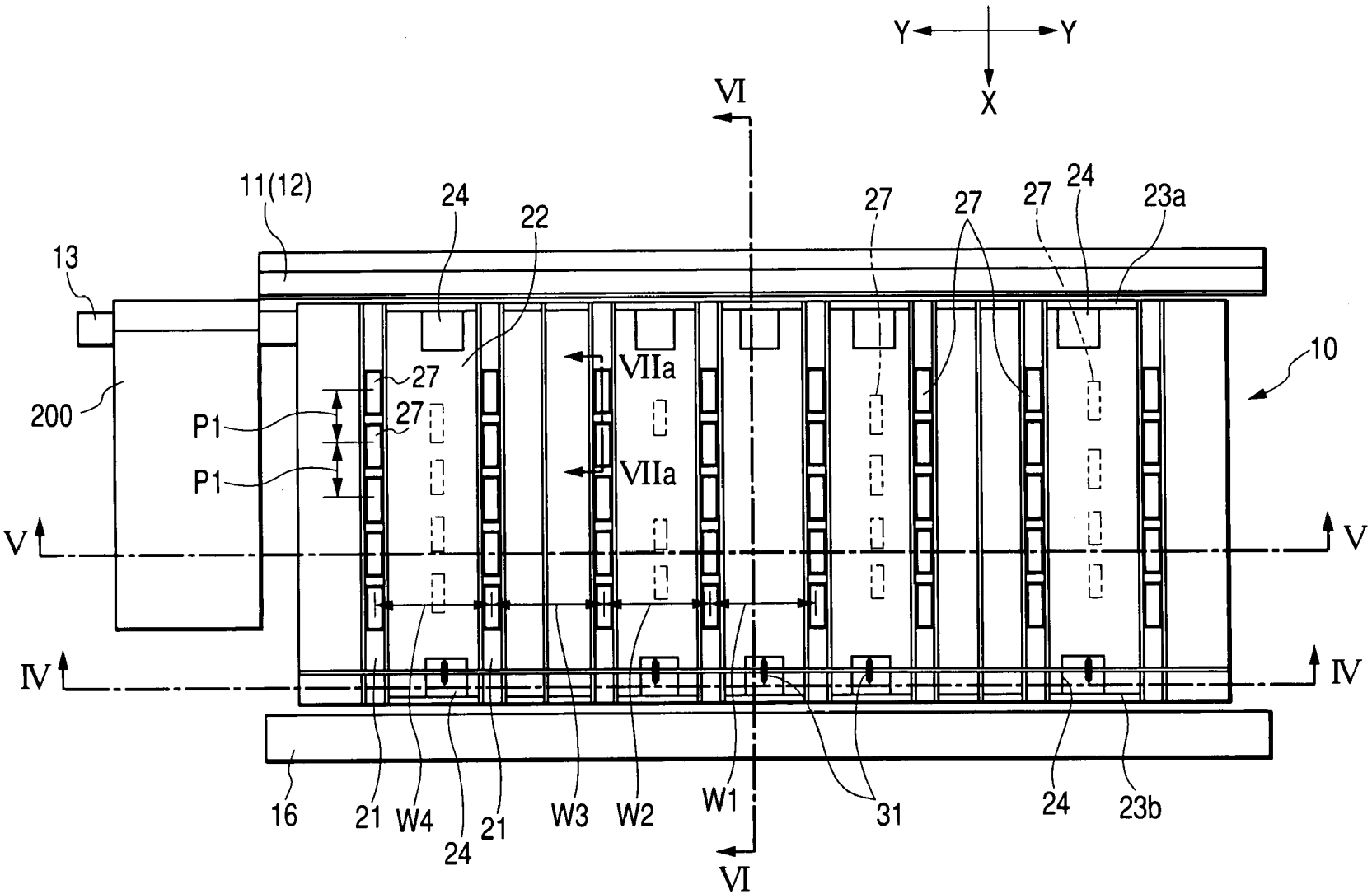
FIG. 3 is a plan view showing the platen according to the first embodiment of the invention.

The configuration of the suction-type platen 10 will be described in detail. A first example is shown in FIGS. 2 and 3. This platen 10 includes a frame having f a box shape in plan view. A partition member 20 having a flat plate shape facing the nozzle face 2*a* of the recording head 2 is provided on an upper face of the platen 10. A plurality of rib portions 21 extending in parallel to the transportation direction (as indicated by an X direction of an arrow in FIG. 2) are provided at regular intervals in the direction orthogonal to the transportation direction (as indicated by Y directions of arrows in FIG. 2), on the upper face of the partition member 20. Each rib portion 21 extends beyond an image forming area on the upstream and downstream sides of the platen 10 in the transportation direction. The image forming area corresponds to a length of a row of nozzle array (as indicated by the size $L_0$ in FIG. 2) disposed at regular intervals along the transportation direction and punctured in the nozzle area 2*a* of the recording head 2. The image forming area is an area where the recording head 2 being moving in the main scanning direction (arrowed Y directions) can form an image at one time, as indicated by two dashed lines L1, L2 in FIG. 2.

An air flow passage 22 extending in the transportation direction is formed between two adjacent rib portions 21. In this example, a height of an upper face of a bottom plate 22*a* (see FIG. 7A) constituting the air flow passage 22 is substantially equal to that of the upper face of the partition member 20. Also, a plurality of rollers 27 functioning as a rolling bodies freely rotatable are disposed at regular intervals (a predetermined pitch P1, about 10 mm to 30 mm in this example) along the transportation direction on the upper face (a surface facing the paper P to be transported) of each rib portion 21. The plurality of rollers 27 are rotatably supported at the predetermined interval P1 around a single support shaft 28 (see FIG. 4). A predetermined interval W between the rows of rollers 27 in the direction orthogonal to the transportation direction corresponds to the arrangement interval of the rib portions 21.

Since the rollers 27 are arranged in the transportation direction, the flatness of the paper P in a state where the transported paper P is supported by the plurality of rollers 27 simultaneously can be reduced. Furthermore, since the plurality of rows, extending in the transportation direction, of rollers 27 are provided, the paper to be transported is laid on the plurality rows of rollers 27. As a result, the paper P can be performed smoothly.

Also, the rollers 27 are arranged in such a manner that an upper end portion of the circumferential face of each roller 27 (a side facing the paper P to be transported) projects by a predetermined size b (see FIG. 7A) from the upper face of the rib portion 21 to a side where the paper P is disposed. In this example, bores having rectangle shapes in plan view may be defined at regular intervals on the upper face of the rib portion 21 so that the upper end portion of each roller 27 can be exposed upwardly through each bore. Alternatively, a long hole extending in the transportation direction may be defined on the upper face of the rib portion 21 to allow the upper end portions of the rollers 27 to be exposed upwardly.

A suction opening 24 is defined on the bottom plate 22*a* (see FIG. 7) of each air flow passage 22 on one or both of the upstream and downstream sides in the transportation direction. In this example, on each air flow passage 22, the suction opening 24 is provided in the region outside the image forming area, for example, at positions on the upstream and downstream sides in the transportation direction. These suction openings 24 are in communication to a negative pressure chamber 25 functioning as an air chamber formed under the partition member 20 of the platen 10 having the box frame shape (see FIGS. 1 and 4). This negative pressure chamber 25 is connected to a suction device 26 having a suction fan or an exhaust pump (see FIG. 1). Therefore, the suction device 26 operates to suck the atmospheric air from the both suction openings 24 on the upstream and downstream sides at least when the paper is transported and when ink is ejected. Inside the negative pressure chamber 25, a lower cover 29 is disposed to cover a lower part of the entire row of rollers 27. The lower cover 29 is fixed to the lower face of the partition member 20. This lower cover 29 cuts off the communication in the gap between the rib portion 21 and each roller 27 to the negative pressure chamber 25. Thereby, even if the atmospheric air is sucked through the suction openings 24 during the activation of the suction device 26, the air is prevented from being sucked into the gap 30*a*, 30*b*. between the rib portion 21 and each roller 27 (see FIGS. 7A and 7B).

Figure 7A:
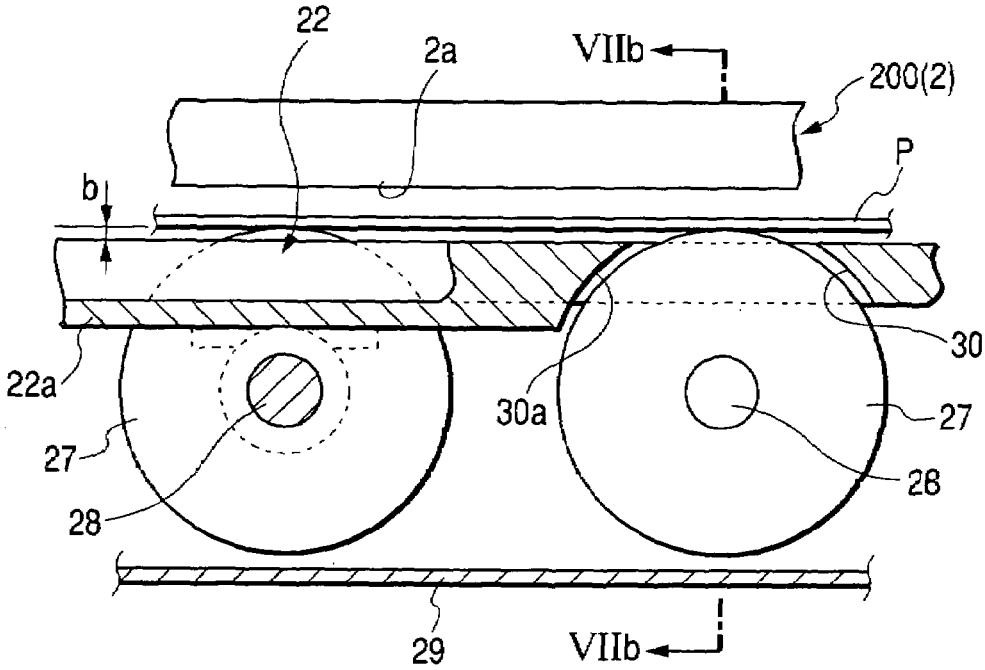
FIG. 7A is a partially enlarged cross-sectional view of FIG. 3, as seen from the arrow of the line VII-VII.
Figure 7B:
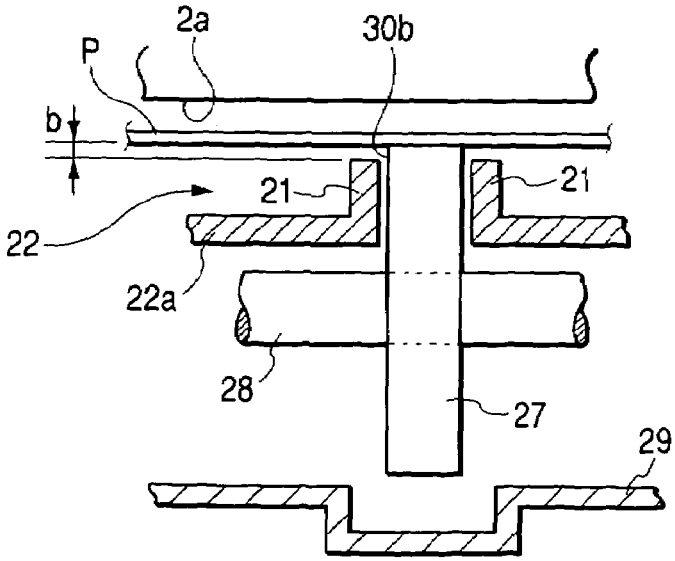
FIG. 7B is a cross-sectional view of FIG. 7A, as seen from the arrow of the line VIIb-VIIb.

The paper P to be transported is supported on the upper ends of the rollers 27, but out of contact with the upper faces of the rib portions 21. As shown in FIGS. 7A and 7B, the projecting amount b is set in a range from 0.1 mm to 0.4 mm, and the radius of the roller 27 is set in a range from 4.3 mm to 20 mm in this example.

When the radius of the roller 27 is set in a range of from 4.3 mm to 20 mm and the projecting amount b of the upper end of the roller 27 from the upper face of the rib portion 21 is set in a range of from 0.1 mm to 0.4 mm as described above, the leading edge of the paper P transported from the upstream side is firstly laid on the upper faces of the rib portions 21, and then is in contact with the projecting portions of the rollers 27. In this state, when the paper P abuts against the projection portion of the rollers 27, the resistance force (load) against the circumferential face of the roller 27 is 0.098 N (Newton) or less to enable the smooth transportation of the paper P. In addition, the flatness of the paper P is improved.

On the upper face of the platen 10, rib-like convex portions 23*a*, 23*b* (see FIG. 6) extending in the direction (Y directions of the arrows) orthogonal to the transportation direction are provided on the upstream and downstream sides of the image forming area in the transportation direction so as to be connected (linked) to the end portions of all the rib portions 21 on the upstream and downstream sides (see FIG. 3).

The suction openings 24 are provided in the air flow passage 22 to be closer to a region where the convex portions 23*a*, 23*b* are disposed. This configuration brings about an effect that a suction air flow from above the platen 10 is produced more easily.

With this configuration, when an image forming (printer) command is issued by a key operation on an operation pane portion, not shown, the suction device 26 is activated, and one sheet of paper P laid in the paper feed tray 5 is fed to the transportation path 7 by a single rotation of the paper feed roller 6, and carried by the pair of transportation rollers 9*a*, 9*b* to the pair of upstream transportation rollers 11, 12. Then, the leading end portion of the paper P is carried in the nip portion between the driven roller 11 and the drive roller 12. The drive roller 12 and the downstream drive roller 16 are intermittently driven in synchronous manner. By multiple intermittent rotations, if the paper P to be transported comes upstream of the image forming area on the upper face of the platen 10, the leading end of the paper P is sucked to be in contact with the upper faces of the rib portions 21 owing to a negative pressure flowing through the air flow passage 22 into the upstream suction opening 24. Then, if the paper P proceeds, the paper P contacts with the front circumferential faces of the rollers 27 projecting from the rib portion 21 and runs thereon.

When the leading end portion of the paper P enters the image forming area and further proceeds, the paper P laid on the upper ends of the plurality of rollers 27 is held to be substantially parallel to the upper end faces of the rib portions 21, due to a large negative pressure in the minute gap between the upper end portions of the circumferential faces of the rollers 27 and the upper face of the rib portion 21. Thereby, even if there is a small gap between the nozzle face 2*a* of the recording head 2 and the upper ends of the rollers 27, the paper P does not contact with the nozzle face 2*a* and is not contaminated.

During the printing operation, a long air path is formed along the transportation direction between the paper P laid on the upper faces of the plural rows of rollers 27 on the platen 10 and each air flow passage 22. Since this air path (air flow passage 22) communicates to the suction openings 24 provided on the upstream side and the downstream side of the image forming area, a negative pressure is generated in this air flow. Therefore, the paper P is prevented from floating up the platen 10 during the printing operation and the intermittent movement of the paper Pin the transportation direction. Even in a state where the paper P is sucked, the paper P can be held flat. This is because the paper P is laid on the upper faces (circumferential faces) of the plurality of rotatable rollers 27. Moreover, in contrast to a case where the concave air flow passage 22 is not formed in the platen 10 and the paper P and the platen 10 are contacted on the same level, the air flow passage 22 extends in the transportation direction and the paper P is supported on the rotatable rollers 27, whereby the paper P is not in contact with the platen 10 but is slightly contact with the rollers 27, and transported with a lighter force.

Incidentally, the flow rate on the bottom plate 22*a* of the air flow passage 22 is set to be equal to or lower than 10% of the ink ejection rate of the recording head 2. If so, since the ink ejection rate is sufficiently faster than the flow rate of air flow of suction, the ink ejected from the nozzle face 2*a* to the paper P is not flowed by the air flow of suction to degrade the printing quality.

In this state, the paper is temporarily stopped, the image is formed in a predetermined area by ejecting ink from the nozzles while the recording head 2 is being moved in the main scanning direction. Then the paper P is intermittently transported by a predetermined amount in the sub scanning direction. This operation is repeated. Even in this case, the gap between the paper P and the nozzle face 2*a* of the recording head 2 can be kept substantially constant.

When the trailing edge of the paper P leaves the pair of upstream transportation rollers 11, 12 and comes downstream of the suction openings 24, the space is increased on the side of the upstream suction openings 24 to reduce the negative pressure in this space. However, since the negative pressure of air flow passing toward the suction opening 24 located on the downstream side of the air flow passage 22 is maintained, the trailing edge of the paper P is moved from the upper ends of the rollers 27 on the downstream side along the circumferential faces of the rollers 27 to the downstream side, and sucked to be in contact with the upper faces of the plurality of rib portions 21. Thereby, even when the trailing edge of the paper P is prone to be curled, the paper P is held in parallel to the upper faces of the rib portions 21 on the platen 10, but out of contact with the nozzle face 2*a* of the recording head 2, and is not contaminated. Particularly, by providing the suction openings 24 on the upstream side and the downstream side of the image forming area, the paper P is sucked beforehand to the upper faces of the rib portions 21 before the leading end of the paper P approaches from the upstream side to the image forming area. Then, the paper P is kept sucked to the upper faces of the rib portions 21 until the trailing end of the paper P leaves the image forming area to the downstream side. Thereby, the paper P is out of contact with the nozzle face 2*a* of the recording head 2 so that the image quality is not degraded.

Figure 4:
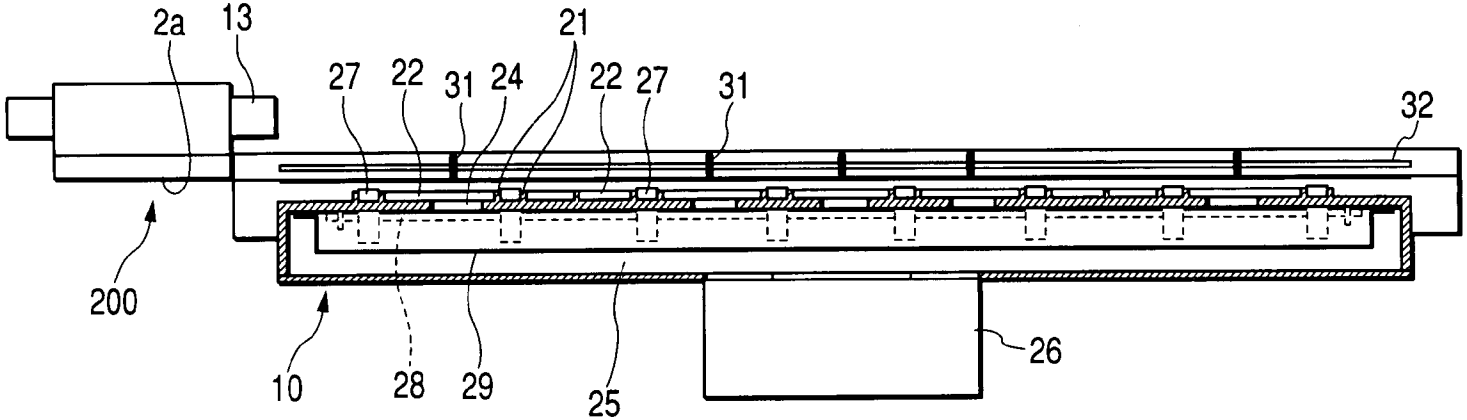
FIG. 4 is a cross-sectional view of FIG. 3, as seen from the arrow of the line IV-IV.
Figure 5:
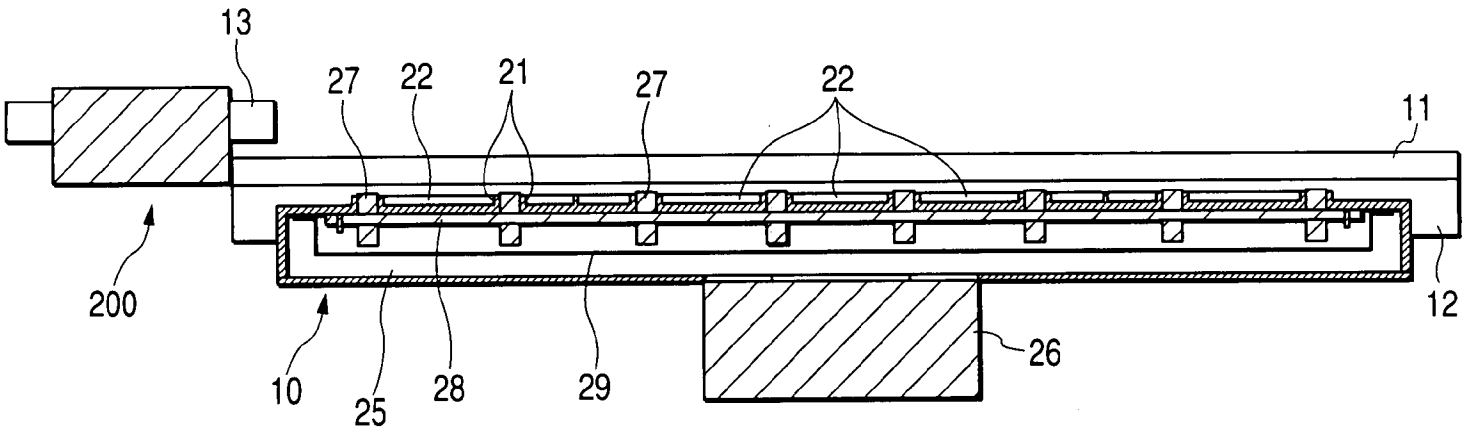
FIG. 5 is a cross-sectional view of FIG. 3, as seen from the arrow of the line V-V.
Figure 6:
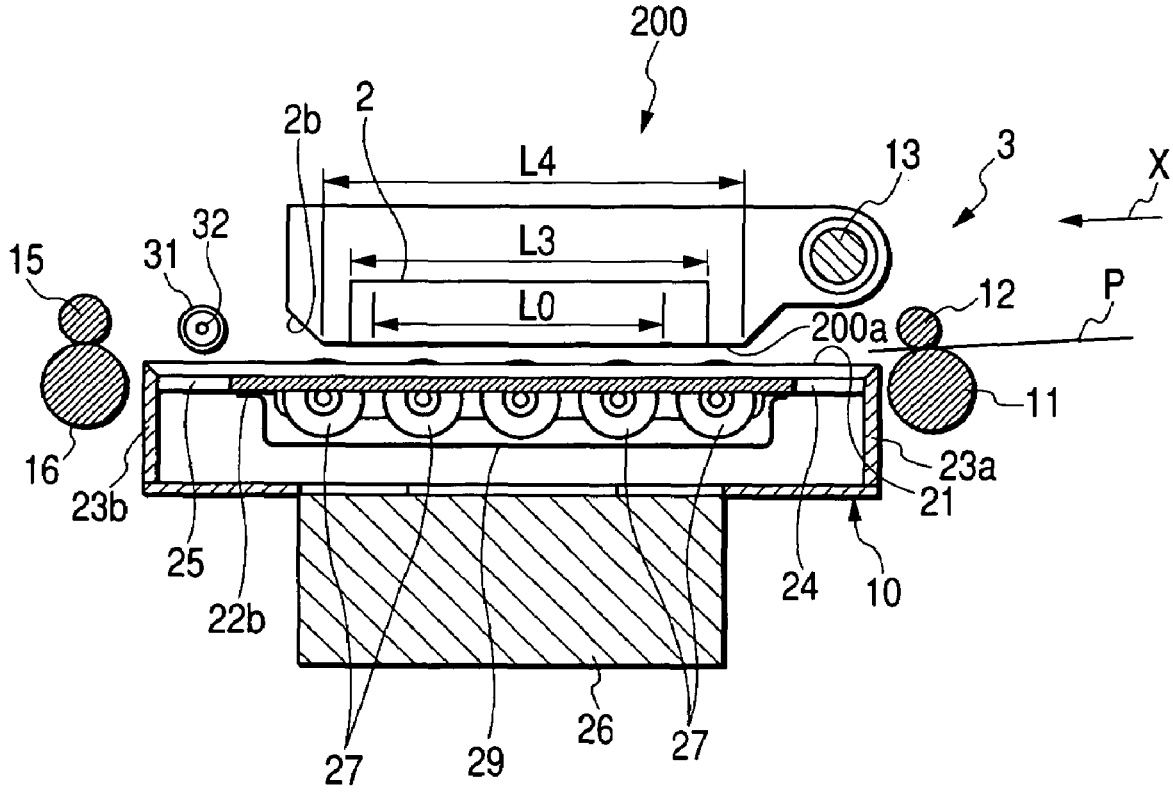
FIG. 6 is a cross-sectional view of FIG. 3, as seen from the arrow of the line VI-VI.

A spur roller 31 for regulating the paper P from floating is supported rotatably around a support shaft 32 and is disposed at a position between a notch portion 2*b* on the downstream side on the lower face of the recording head 2 and the pair of downstream transportation rollers 15, 16, and above the platen 10. Thereby, the paper P having the ink ejected thereon is more effectively prevented from rubbing against the lower face of the recording head 2, as shown in FIGS. 1, 4 and 6.

A roller may be provided within or near the opening portion of the platen and driven for rotation along with the pair of upstream transportation rollers and the pair of downstream transportation rollers. When the air is sucked from the gap between the opening portion and the roller into the inside of the platen, a suction force is applied in the direction of the roller, so that the paper P is brought into close contact with the circumferential face of the roller. In this state, the paper P must be transported with a transporting force of the roller against a resistance of suction. Thereby, as the suction force is greater, the driving force for transporting the paper P must be increased, for which an excess energy is required. Also, since the paper is supported by the roller and transported, a transmission mechanism for driving the roller is needed, resulting in a problem that the configuration becomes complex.

However, if the rollers 27 are employed as in the above example, the paper P is smoothly transported with a simple configuration. Also, since the suction openings 24 are separated to some extent in the transportation direction from the rollers 27, there is less wasteful load on the rollers 27 due to suction. As a result, the paper P is smoothly transported to perform the excellent printing.

Figure 8:
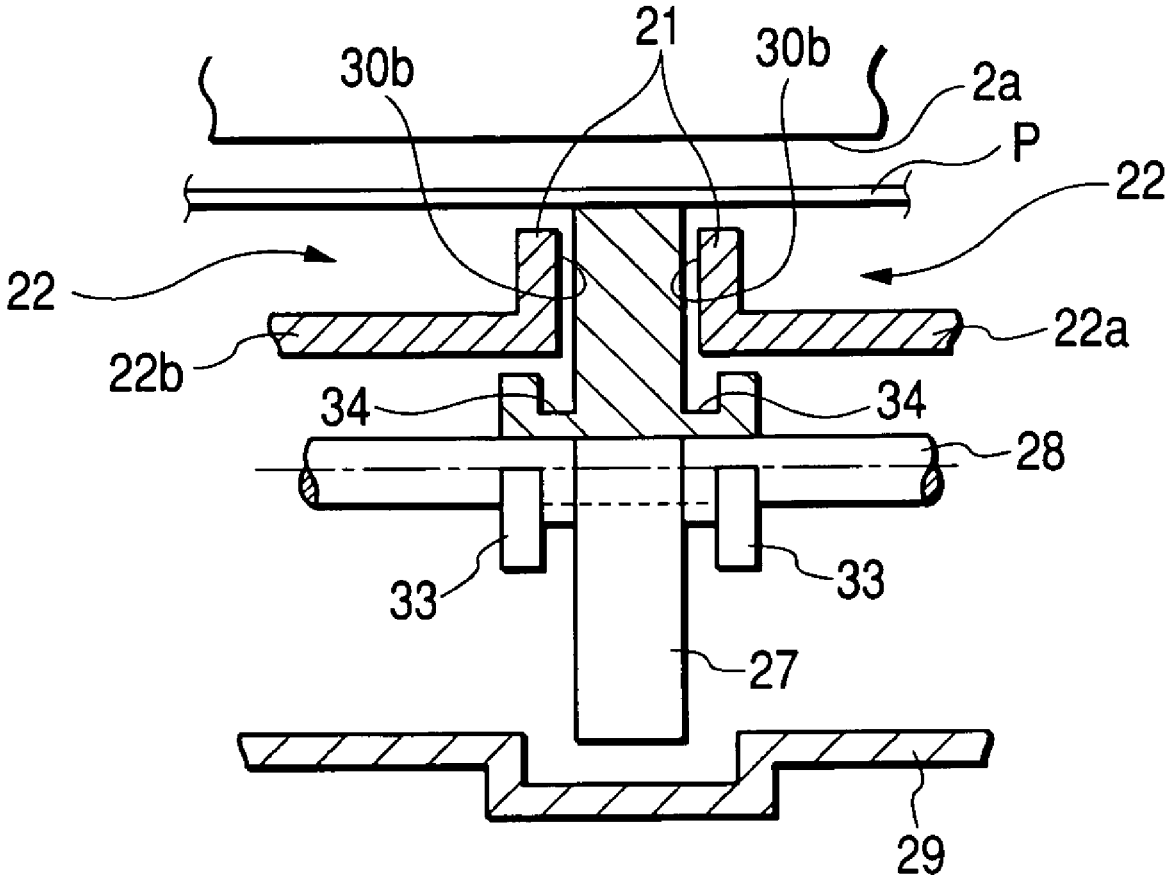
FIG. 8 is a cross-sectional view of a roll according to another embodiment.

In a second example as shown in FIG. 8, an annular groove 34 is formed around the outer circumference of a boss portion 33 of the roller 27. This annular groove 34 is located just under a gap 30*b* between the side face of the large diameter portion of the roller 27 and the side face of the rib portion 21. Thereby, when the ink ejected downwards from the nozzles of the recording head 2 passes through the gap 30*a*, 30*b* and drips down, it is prevented that the ink passes along the side faces of the rollers 27, is gathered in a shaft hole for the support shaft 28, and obstruct the rotation of the rollers 27.

Though being not shown in the figure, the air flow passage 22 has such a cross-sectional shape in the direction orthogonal to the transportation direction that the side face of the rib portion 21 and the bottom plate 22*a* of the air flow passage 22 are at right angle, or the bottom plate 22*a* may be sloped upwards as coming closer to the side face of the rib portion 21.

Figure 9:
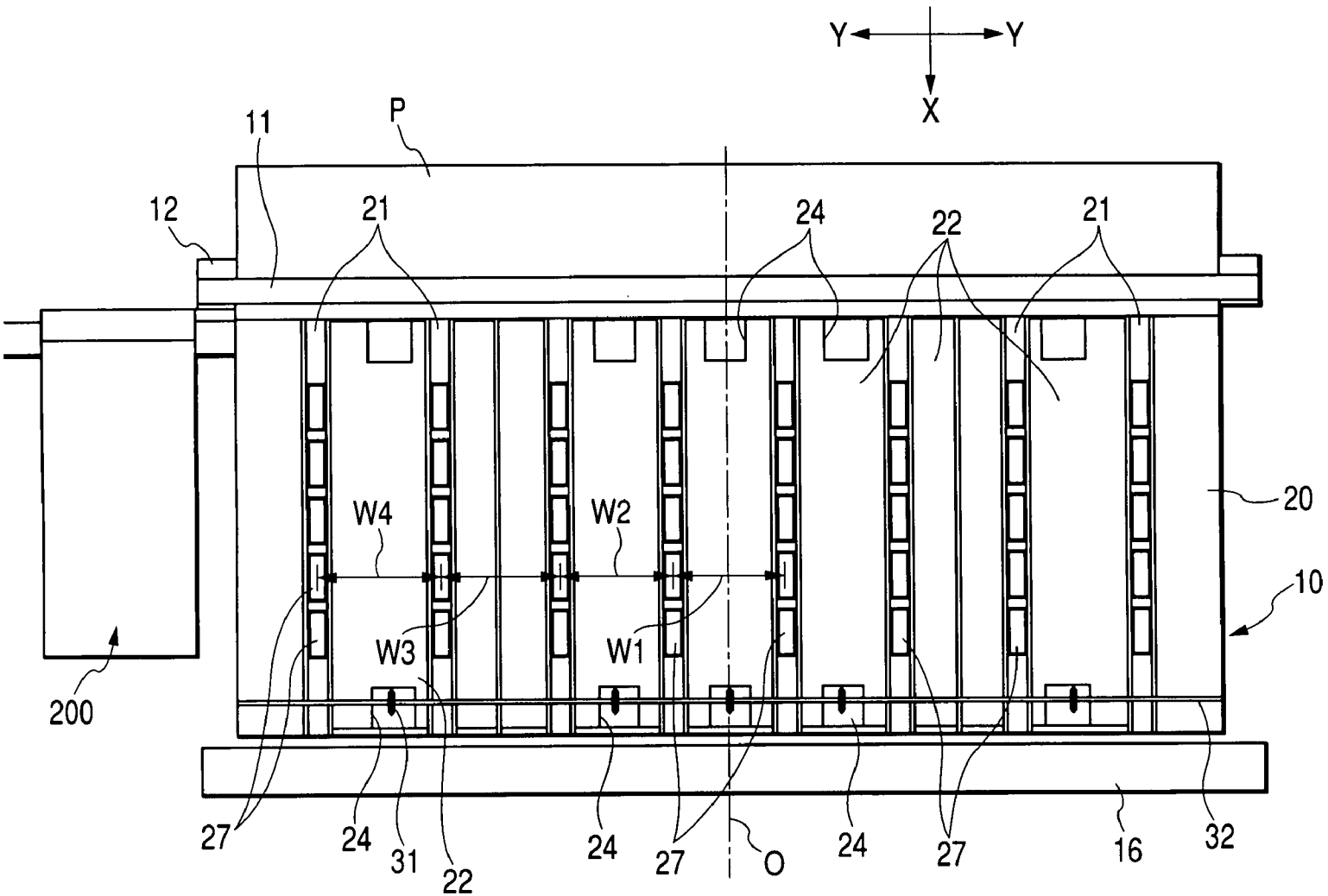
FIG. 9 is a plan view showing a platen according to another embodiment.
Figure 10:
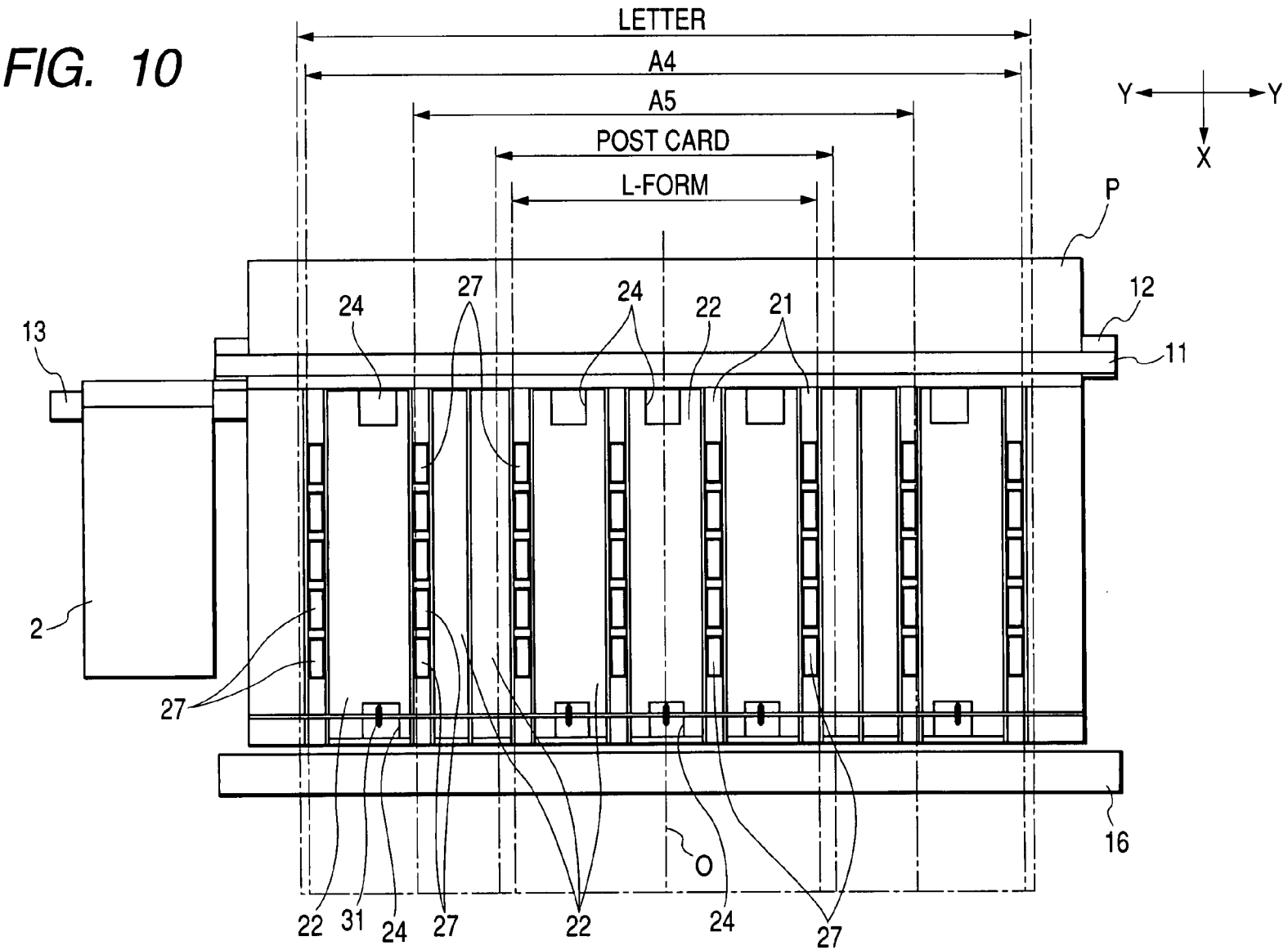
FIG. 10 is a plan view showing a platen according to a further embodiment.

In the above examples, when the paper P is transported while a central line in the width direction of the paper P is almost matched with a central position O of the platen 10 in the direction orthogonal to the transportation direction, the plural rows of rollers 27 disposed along the transportation direction may be arranged in symmetry about the central line O, as shown in FIGS. 9 and 10. Thereby, the paper P is contacted with the rollers 27 more stably in the left and right than a case where the paper P is laid on the rows of rollers 27 arranged in asymmetry. If the predetermined intervals W1, W2, W3 and W4 between the rows of rollers 27 in the direction orthogonal to the transportation direction are set to be gradually wider in the portions of the platen 10 closer to the left and right ends than the central portion of the platen 10 in the direction orthogonal to the transportation direction, the amount of the paper P at the left or right side edge falling into the air flow passages 22 is reduced. As a result, both end portions of the paper P are out of contact with the ink gathered on the bottom of the air flow passages 22, and the paper P transported is easily maintained flat in the direction orthogonal to the transportation direction of the paper P. Also, when the paper P is transported in accordance with the regular size (letter size, A4 size, A5 size, postcard, L-form) that has different width from each other, a part of the paper P near the left and right side edges of the paper P is more easily supported by the upper ends of the rollers 27 than a case where all the intervals between the adjacent rows of rollers 27 are equal (see FIG. 3). As a result, there is less fear that the paper P floats up (see FIG. 10).

Figure 11:
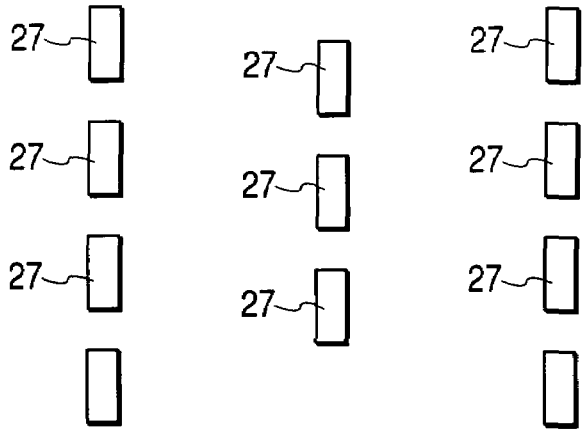
FIG. 11 is a plan view showing the arrangement of the rows of rolls according to another embodiment.

When the plurality of rollers 27 are arranged in one row along the transportation direction, the operation of transporting the paper P is more stable at the equal pitch of arrangement (pitch P1) in the transportation direction than at irregular pitch. Furthermore, when the rollers 27 are arranged at the predetermined pitch P1 in the transportation direction, support positions where the rollers 27 support the paper P are arranged at regular intervals, so that the flatness of the paper P is improved. Even in a case where the intervals of arranging the rollers 27 are equal (pitch P1) in the transportation direction, the rolls may be arranged in staggered form in the transportation direction between the adjacent rows of rollers 27 (i.e., the support shaft 28 of the roller 27 is shifted in the transportation direction), as shown in FIG. 11.

Further, in the above examples, the row of rollers 27 may be provided not only in the rib portion 21 but also in the air flow passage 22, for example, as indicated by the dashed line in FIG. 3. Alternatively, the row of rollers 27 may be provided only in the air flow passage 22. In this case, it is not required that the row of rolls is provided in all the rib portions 21 and/or air flow passages 22. In these cases, it is preferable that the lower cover 29 shuts off the communication from the gap between each roller 27 and its disposed hole to the negative pressure chamber 25.

If the upstream suction opening 24 and the downstream suction opening 24 are communicated by one negative pressure chamber (air chamber) 25, it is only required to provide one negative pressure 25 for sucking the atmospheric air through both the suction openings 24 at the same time, and one suction device 26 connecting to the negative pressure chamber 25, bringing about the effect of making the apparatus compact.

Further, if the total areas of the upstream and downstream suction openings 24 are designed to be equal, the suction strengths for the suction openings are substantially equalized, bringing about the effect of making the suction action for the paper P suitable.

Assuming that the length of the nozzle face 2*a* having the row of nozzles in the transportation direction is L3 (>L0), and the length of a surface, facing the platen 10, of the recording head 2 or a surface, facing the platen 10, of the carriage 200 mounting the recording head 2*a* in the transportation direction is L4 (>L3>L0) (see FIG. 6). When the nozzle face 2*a*, the recording head 2 or the carriage 200 mounting the recording head 2*a* is moved in the direction orthogonal to the transportation direction, an area (not shown) where the surface, facing the platen 10, of the nozzle face 2*a*, the recording head 2, or the carriage 200 passes is larger than the image forming area. The surface, facing the paper carriage 10, of the nozzle face 2*a,* the recording head 2, or the face of the carriage 200 mounting the recording head 2 confronts the upper face of the platen 10. In an area with a narrow gap therebetween, an air flow occurring in the suction openings 24 causes an air flow between the recording head 2 or the carriage 200 and the printed face of the paper P, having an adverse influence on the image. Therefore, the suction openings 24 are provided on one or both of the upstream side and the downstream side of the passage area, so that the suction action at the leading edge of the paper P in free state and the suction action at the trailing edge are made outside the passage area. Thereby, the paper P is out of contact with the surface, facing the paper carriage 10, of the nozzle face 2*a,* the recording head 2, or the face of the carriage 200 mounting the recording head 2, to which the ink is likely to stick. Consequently, the paper P is securely prevented from being contaminated by the ink.

The suction openings 24 provided on the platen 10 are provided on the upstream side and/or downstream side of the nozzle face 2*a* or the area where the nozzle face 2*a* moves. Therefore, even if ink is ejected from the nozzle face 2*a* at a time when the paper P does not cover the suction openings 24, the air flow of suction does not influent on the printing. Furthermore, a gap between the paper P sucked by the platen 10 and the nozzle face 2*a* of the recording head 2 can be kept to be constant. As a result, there is no fear that the paper P rubs against the nozzle face 2*a* or the surface, facing the paper P, of the recording head 2. The formed image is not contaminated or disordered with the ink.

The printing is performed more excellently in a case where the suction openings 24 are kept away from an area where the platen 10 faces the recording head 2 than a case where the suction openings 24 are kept away from an area where the platen 10 faces the row of nozzles on the nozzle face 2*a* of the recording head 2. This is because the ejected ink is less affected by sucking the atmospheric air.

In the above examples, the width size of the upper face of the rib portion 21 and the width size of the circumferential face of the roller 27 (in the direction orthogonal to the transportation direction) may be widened. Also, one or more notches are provided in the middle of the rib portion 21 (between the adjacent rollers 27) in the longitudinal direction (transportation direction) to direct the air flow to the adjacent air flow passages 22.

Further, it is assumed that the gap 30*a,* 30*b* between the rib portion 21 and the roller 27 is quite small and the resistance of air flow passing through the gap 30*a,* 30*b* at the time of suction is large. Even when the lower cover 29 is omitted, an air flow occurs through the air flow passage 22 due to a suction force through the suction opening 24 having substantially large area. Therefore, the paper P is transported by the rollers 27 with the lower face of the paper P held in contact with the rows of rollers 27.

In another example, though being not shown, the convex portion 23*a* on the upstream side may be continuously provided, and on the downstream side of the image forming area in the transportation direction, the rib-like convex portion 23*b* may be connected (linked) to the end portions of two adjacent rib portions 21 on the downstream side at every other air flow passages 22 (with one air flow passage 22 interposed). The convex portions 23*a,* 23*b* may be disposed to have a slight gap with the rib portion 21. In this case, the air (atmospheric air) flow through the air flow passage 22 is not hindered. Thereby, the same effects are obtained as where the convex portions are connected.

Also, the whole of the platen 10 may be curved convexly such that it is higher in the middle in the direction orthogonal to the transportation direction (width direction of the paper P), and lower on both end portions over the paper width.

Moreover, the invention maybe applied to an image forming apparatus in which the recording head is mounted on the carriage 200 as a part of a moving unit and moved in the direction orthogonal to the transportation direction, or an image forming apparatus in which the recording head is formed lengthwise in the direction orthogonal to the transportation direction and not moved (a line recording head for allowing an image to be formed over the width of the paper P at a time).

A lower portion 200*a* of the carriage 200 around the nozzle face 2*a* of the recording head 2 is formed at the same height as the nozzle face 2*a,* as shown in FIG. 6. However, the lower portion 200*a* may be formed substantially at the same height as the nozzle face 2*a,* unless the printing is hindered. That is, the "substantially at the same height as the nozzle face" may stand for the same and substantial same.

Second Embodiment

A second embodiment of the invention will be described below. In the following description, the same or similar parts are assigned the same reference numerals as the first embodiment, and description thereon will be omitted.

Figure 12:
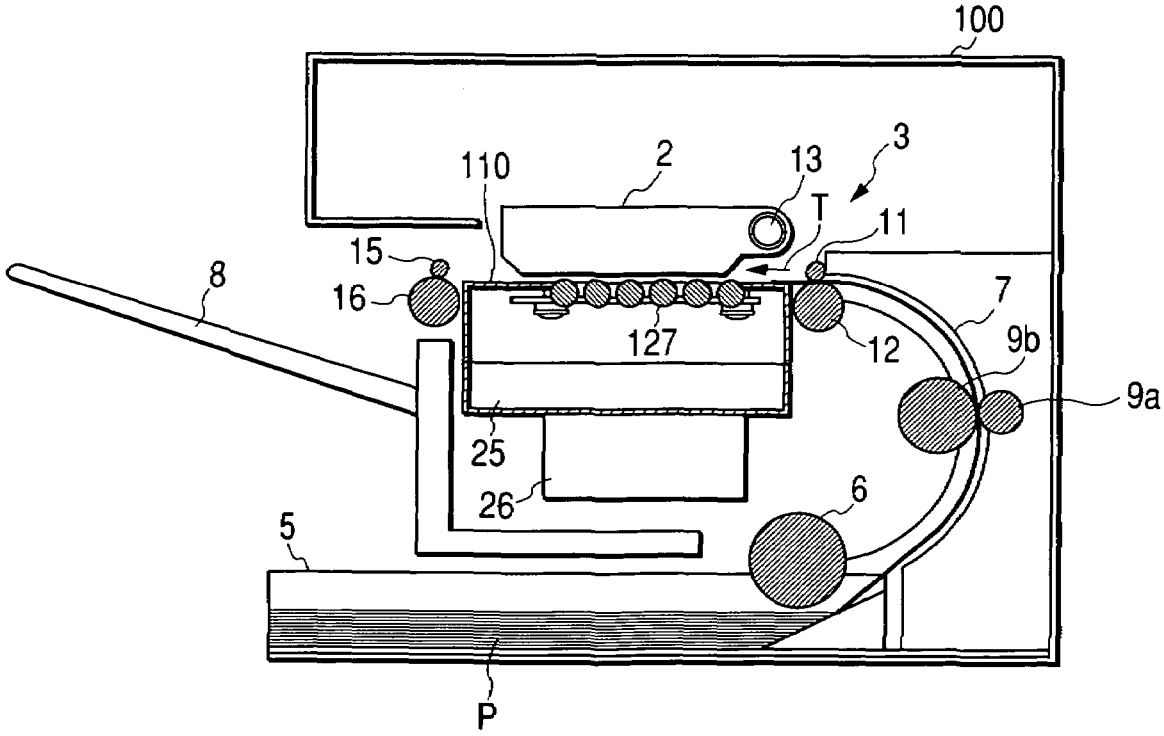
FIG. 12 is a side cross-sectional view showing an outline configuration of an image forming apparatus 100 according to a second embodiment of the invention.

FIG. 12 is a side cross-sectional view showing an outline configuration of an image forming apparatus 100 according to a second embodiment of the invention.

Also, a platen 110 has a plurality of rollers 127, which are rotatable around a rotation axis orthogonal to a transportation direction T (indicated by an arrow) of a paper P and project from a surface of the platen 110. Also, suction openings 115 (not shown in FIG. 12) are defined on the surface of the platen 110 to communicate to a negative pressure chamber 25 extending over the bottom face of the platen 110. Moreover, a suction device 26 for sucking the atmospheric air within the negative pressure chamber 25 and exhausting it is provided on the lower side of the negative pressure chamber 25. A suction force of this suction device 26 is roughly 100 Pa or less.

When the paper P is transported on the platen 110, the head 2 is reciprocated along a guide shaft 13 to print on the paper P (on a surface of the paper P other than a surface facing the platen 110). At this time, the paper P is moved on the platen 110 in contact with the rollers 127, while being sucked together with the atmospheric air through the suction openings 115 (not shown in FIG. 12) defined on the surface of the platen 110. Along with this, the rollers 127 are rotated counterclockwise in FIG. 12, so that the transporting load is reduced and the paper P is transported smoothly.

Figure 13:
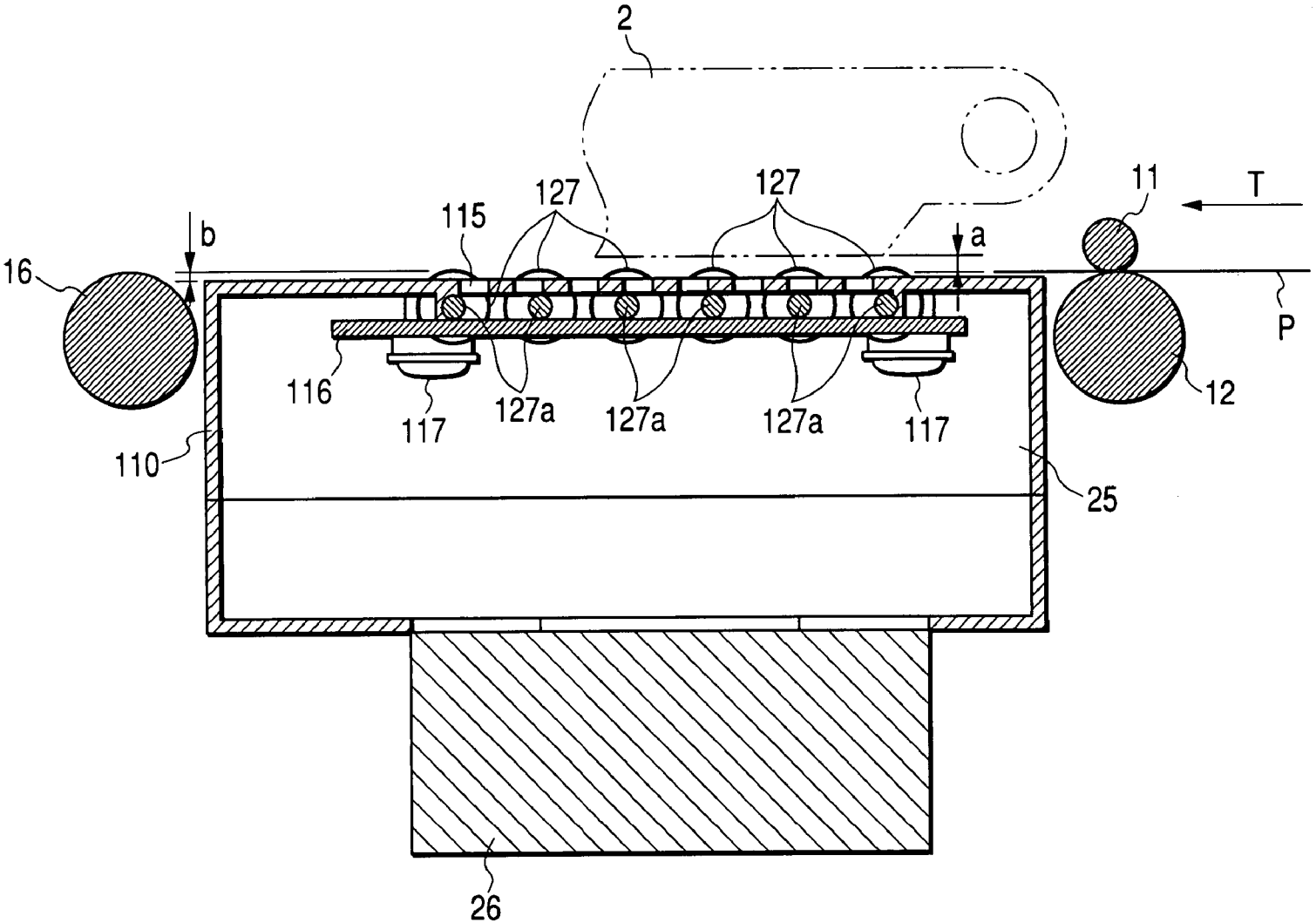
FIG. 13 is a side cross-sectional view showing the configuration of the vicinity of the platen 110 for the image forming apparatus according to the second of the invention.

FIG. 13 is a side cross-sectional view showing the configuration of the vicinity of the platen 110 for the image forming apparatus according to the second of the invention. In FIG. 13, the platen 110 has the plurality of rollers 127, which are rotatable around the rotation axis 127*a* orthogonal to the transportation direction T of the paper P and project from the surface of the platen 110. Also, the suction openings 115 are defined on the surface of the platen 110 to communicate to the negative pressure chamber 25 extending over the bottom face of the platen 110.

The rotation axis 127*a* of the roller 127 is provided on a rear side of the platen 110, namely, inside the negative pressure chamber 25, in this embodiment. Similarly, a planar bearing plate 116 is attached to the rear side of the platen 110 within the negative pressure chamber 25 by the screws 117. The bearing plate 116 forms a bearing portion, not shown, on which the rotation axes 113*a* of the rollers 127 are rotatably supported, as will be detailed later.

In FIG. 13, the projecting amount of the roller 127 from the surface of the platen 110, in other words, the gap (indicated by b size) between the lower face of the paper P (uppermost portion of the roller 127) and the surface (upper face) of the platen 110 is predetermined. With this gap, a conventional problem does not arise that when a part of the suction openings are closed by an end portion of the paper to make the width of the opening smaller, the end portion of the paper is vibrated to produce a whistling wind sound under the action of the atmospheric air passing through this end portion by suction.

On the other hand, when the flow rate of the air stream arising between the head 2 and the paper P is 10% or less of a nozzle ejection rate of the head 2, the image quality is not deteriorated. Therefore, b size is 2 mm or less. Thereby, the conventional problem does not arise that the ejected ink are disturbed when ink droplets are ejected onto the paper under the influence of the atmospheric air sucked through the suction openings.

Conversely, if the gap is greater than 2 mm, the atmospheric air, which is unsuitable for printing, occurs on the paper P, so that a stable flow of the atmospheric air is not kept. As a result, there is a great influence on the ejection performance of ink droplets. While b size is 2 mm or less, the predetermined gap indicated by a size between the upper face of the paper P and the lower face of the head 2 is set to 1 mm or less. Moreover, if the radius of the roller 127 is in a range of 4.3 mm to 20 mm, and b size is in a range of 0.1 mm to 0.4 mm, the transporting condition of the paper is stabilized, so that the excellent image quality is obtained. The radius of the roller 127 has the upper limit, because if the interval between the rollers is beyond 40 mm, the paper P is more flexed to contact with the surface of the platen 110. Also, b size has the lower limit, because 0.1 mm is valid in mounting in consideration of the tolerance.

Figure 14:
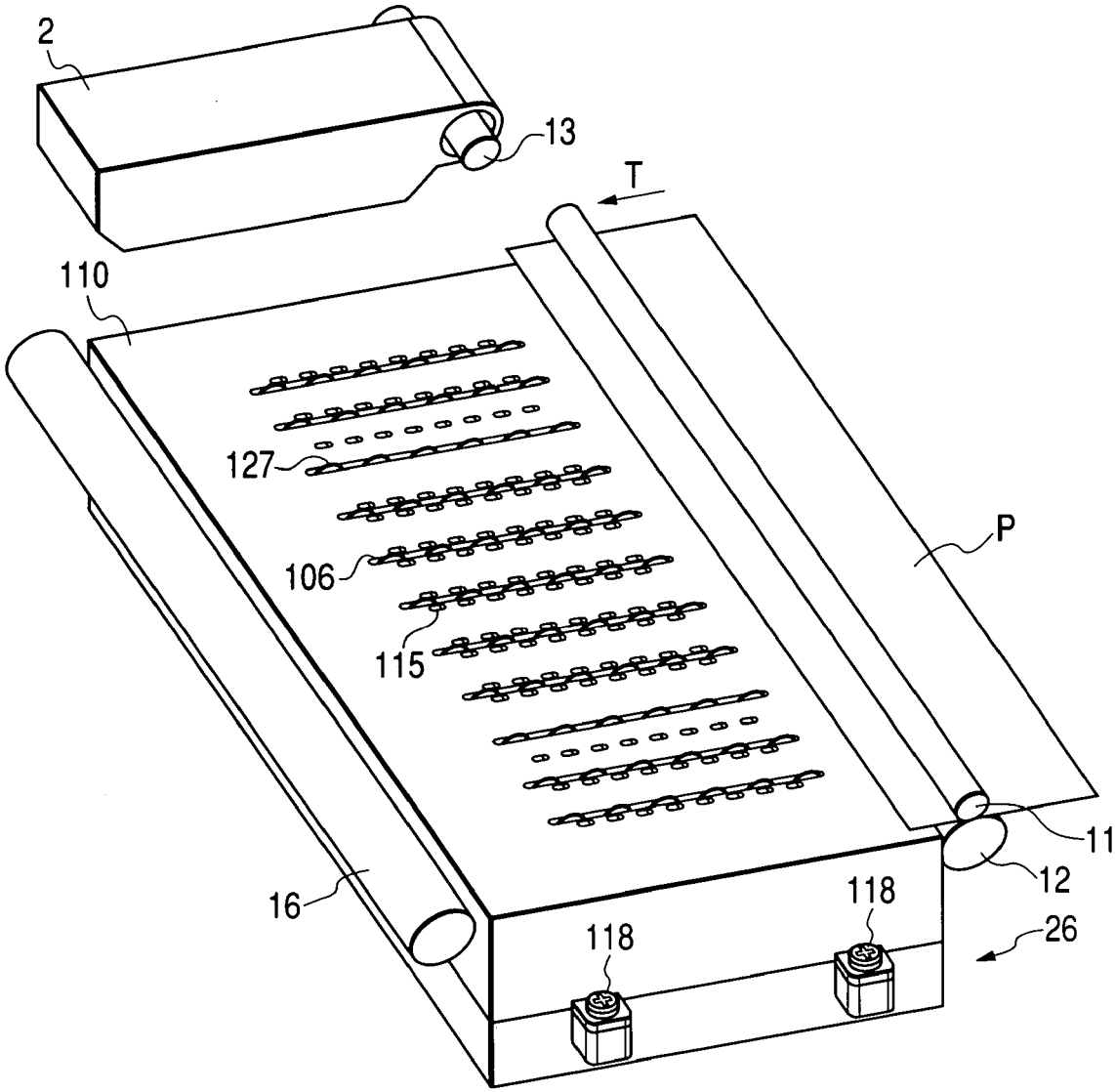
FIG. 14 is a perspective view showing the platen 110 and its neighborhood according to the second embodiment of the invention.
Figure 15:
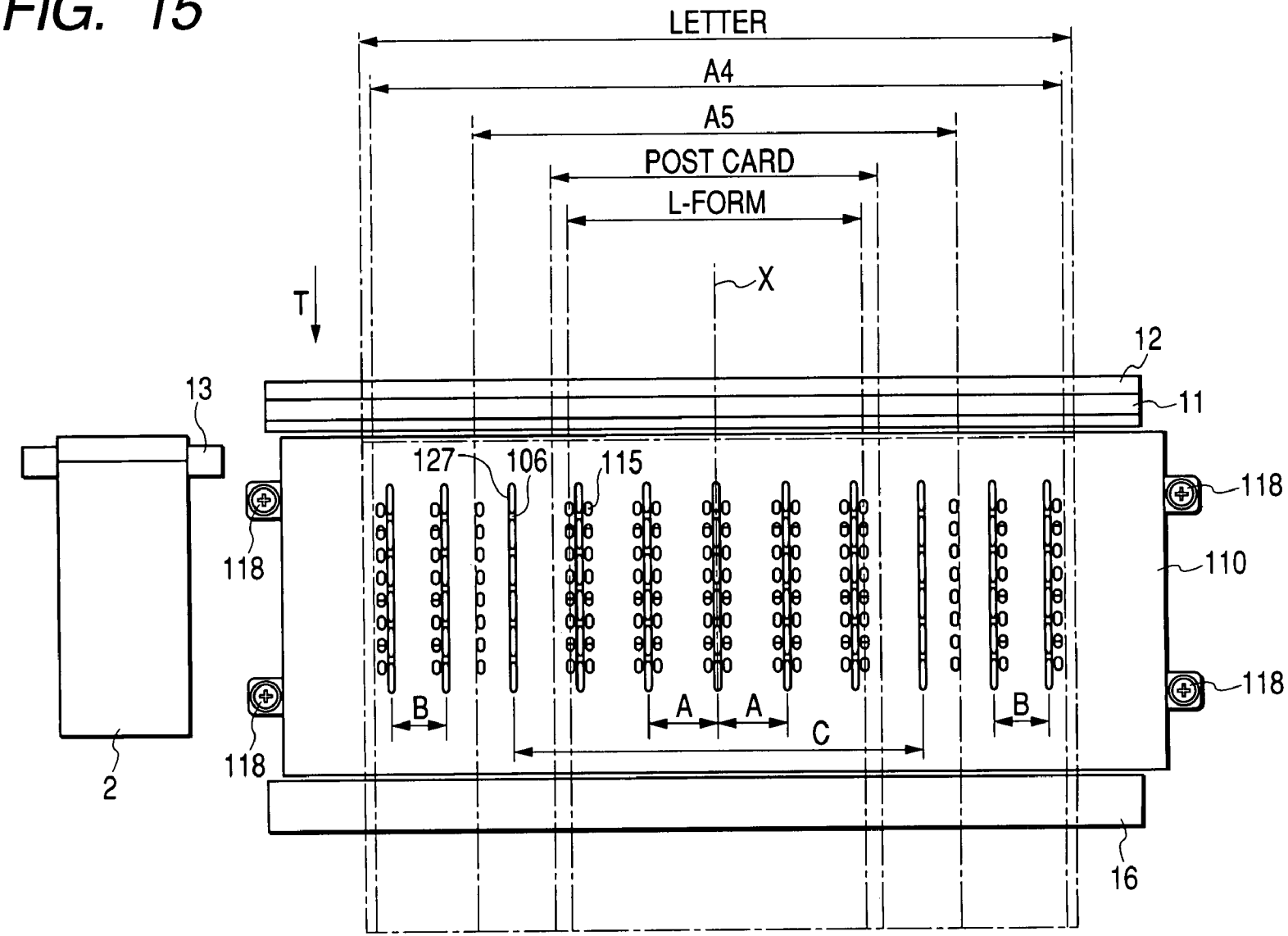
FIG. 15 is a plan view showing the platen 110 and its neighborhood according to the second embodiment of the invention.

FIG. 14 is a perspective view showing the platen 110 and its neighborhood according to the second embodiment of the invention. Also, FIG. 15 is a plan view showing the platen 110 and its neighborhood according to the second embodiment of the invention. In FIGS. 14 and 15, the guide shaft 13 for guiding the head 2 is partially depicted, but in practice, provided over the almost entire length in a direction orthogonal to the transportation direction T. In this connection, the upper and lower sides of the negative pressure chamber 25 are tightly fixed by the screws 118 to be hollow.

As shown in FIGS. 14 and 15, slit-like through holes 106 are defined along the transportation direction T on the surface of the platen 110. The plurality of rollers 127, which project from the surface of the platen 110 via the through holes 106, are disposed, for example, at an equal pitch along the transportation direction T. Thereby, it is possible to transport the paper P stably. Moreover, the plurality of rollers 127 thus disposed form one row and the plural rows of the rollers 127 are disposed in the direction orthogonal to the transportation direction T. The outgoing lines for the rollers 127 and the suction openings 115 are depicted only in part to avoid the complicate drawings.

Also, the suction openings 115 for sucking the atmospheric air are provided between the rows of rollers 127 on the surface of the platen 110. The suction openings 115 are mainly disposed in the neighborhood of the rollers 127. The suction openings 115 are defined on both sides of five rows of the rollers 127 at the center of the platen 110. Also, the suction openings 115 are defined on outsides of the outermost two rows of rollers 127.

Also, the rollers 127 are disposed in line symmetry about the central line X parallel to the transportation direction T, as shown in FIG. 15. Moreover, the pitch between the rows of rollers 127 becomes smaller as approaching more outside. That is, A size that is the pitch near the center is larger than B size outside in FIG. 15. In other words, a widening ratio of the width between a pair of rollers (C size in FIG. 4) disposed in line symmetry about the central line X becomes smaller, as approaching more outside in the direction orthogonal to the transportation direction T.

FIG. 15 shows a relationship between the width of each paper size about the central line X and the platen 110. That is, the widths of regular forms such as letter, A4, A5, postcard, and L-form are illustrated. As will be seen from the figure, the suction openings 115 are roughly located near the outside edge of the paper of regular size in the direction orthogonal to the transportation direction T. Thereby, the end portion of the paper is prevented from floating and the paper P is held stably. Herein, the paper is arranged in a so-called center registration manner, in which the paper is arranged roughly with reference to the center even if the paper width is different. In the above way, the paper P is stably contacted with the rollers 127 and stably transported.

The flatness of the paper is defined as $$(\text{Average distribution negative pressure})\times(\text{pitch between rollers})^4/(\text{Clark rigidity}).$$

Thereby, the negative pressure of suction and the pitch of the rollers 127 are decided so that the flatness may be in an optimal range for printing for various kinds of paper. Preferably, when the paper is in contact with the rollers 127, the flatness of the paper is equal to or lower than 0.1 mm, more preferably, equal to or lower than 0.05 mm. Instead of satisfying such flatness condition, tops of the rollers 127 may be in a range of 0.1 mm, more preferably in a range of 0.05 mm. Also, the rolling friction of the rollers 127 is made as small as possible, so that the load in the transportation direction T of the rollers 127 applied on the paper P is 10 gf or less, namely, 0.098N or less. Thereby, the paper is transported smoothly and stably.

In this embodiment, all the rollers 127 can be rotated independently from each other. In this case, the phrase that the rollers are rotated independently means a state where the rollers 127 in contact with the paper P are rotated as the paper P is transported, but other rollers 127 are not rotated because they are not in contact with the paper P. In this way, when the rollers 127 are rotated independently, the rollers 127 in contact with the paper P are rotated in accordance with the width or length of the paper P, whereby the transporting load by the rollers 127 is reduced.

Figure 16:
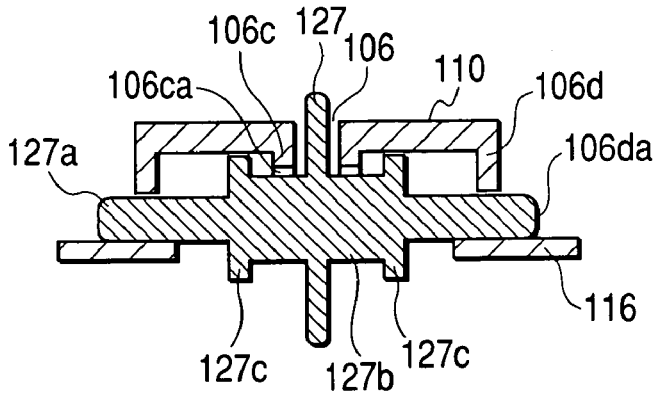
FIG. 16 is a cross-sectional view showing the roller 127 and its neighborhood according to the second embodiment of the invention.
Figure 17:
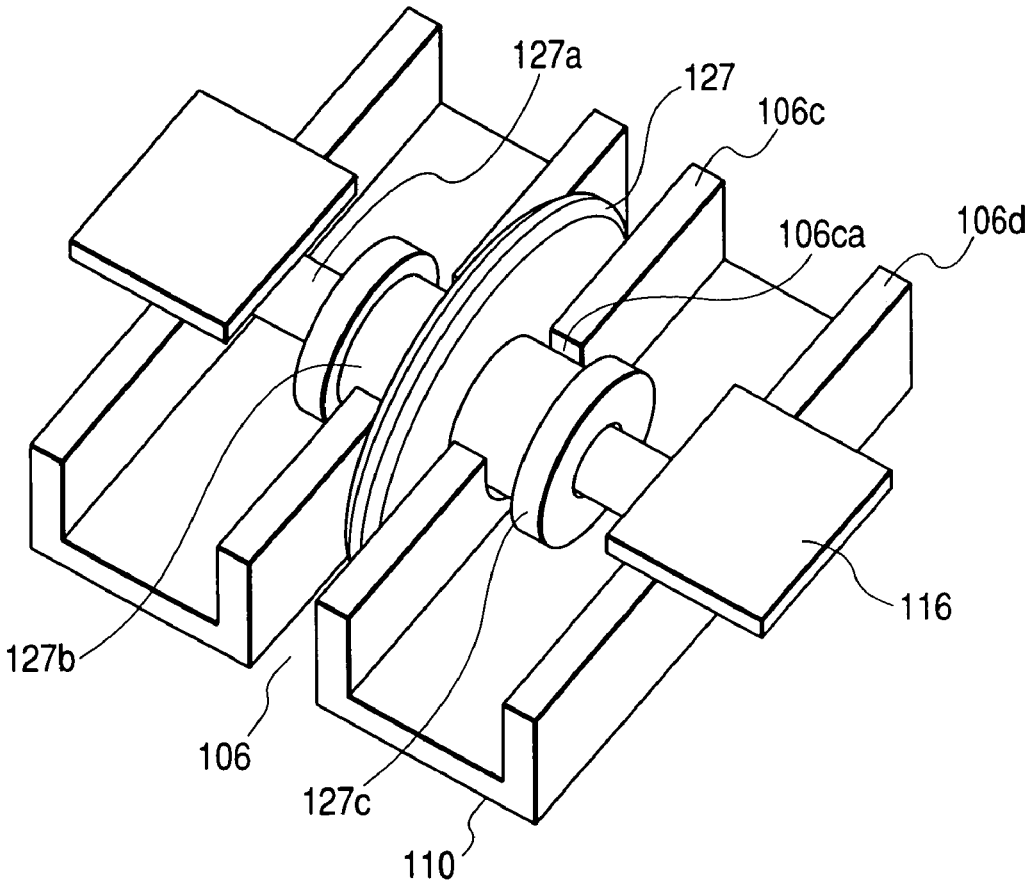
FIG. 17 is a perspective view showing the roller 127 and its neighborhood according to the second embodiment of the invention, as viewed from the lower side.

A configuration in which ink are prevented from flowing into sliding portions of the rollers 127 will be described below. FIG. 16 is a cross-sectional view showing the roller 127 and its neighborhood according to the second embodiment of the invention. FIG. 17 is a perspective view showing the roller 127 and its neighborhood according to the second embodiment of the invention, as viewed from the lower side. As shown in FIGS. 16 and 17, the roller 127 projects from the surface of the platen 110 through a through hole 106 defined on the surface of the platen 110. A columnar portion 127*b* projects from both sides of the roller 127 in the direction of a rotation axis 127*a*. Moreover, flange portions 127*c*. are molded integrally around the rotation axis 127*a* on both end portion of the columnar portion 127*b*. Since the flange portions 127*c* are molded integrally around the rotation axis 127*a*, it is easy to manufacture the flange portions 127*c* and to mount the rollers 127 to the platen 110. As a result, the manufacturing cost can be reduced. Herein, the roller 127 and the rotation axis 127*a* are rotated together.

On the other hand, ribs 106*c* integrally molded project from the rear face of the platen 110 on both sides in the direction of the rotation axis near the through hole 106. Each rib 106*c* defines a notch 106*ca* of a semicircular shape as viewed axially. The ribs 106*c* surround the columnar portion 127*b*. Also, ribs 106*d* extend from the rear face of the platen 110 towards the neighbor of both ends of the rotation axis 127*a*. Each rib 106*d* defines a notch 106*da* of a semicircular shape as viewed axially. The ribs 106*d* surround the rotation axis 127*a*. The ribs 106*d* and the bearing plate 116 sandwich the rotation axis 127*a* to form the bearing portion.

In the above configuration, even if the ink permeates through the through hole 106, the rib 106*c* and the flange portion 127*c* function as an ink prevention wall, so that the ink remains on the surface of the columnar portion 127*b* or drips therefrom. As a result, the ink don't reach the bearing portion near the both ends of the rotation axis 127*a*, which is the sliding portion of the roller 127. Thereby, it does not occur that the ink flows into the sliding portion and is fixed to impair the roller 127 from being rotated, resulting in a greater transporting load than when the roller 127 is rotated. Furthermore, it can be prevented that the ink is adhered to the bearing portion so that the adhered ink interferes the rotation of the rollers 127.

Figure 18:
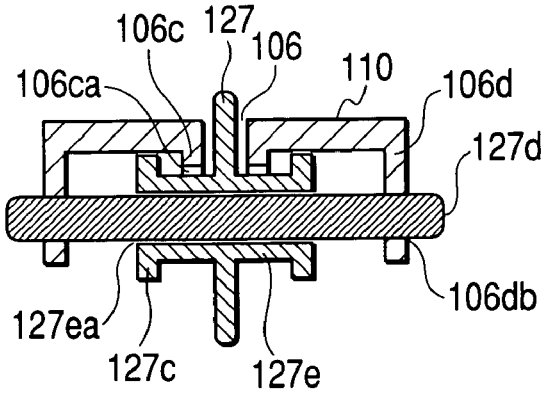
FIG. 18 is a cross-sectional view showing the roller 127 and its neighborhood according to the modification example of the invention.
Figure 19:
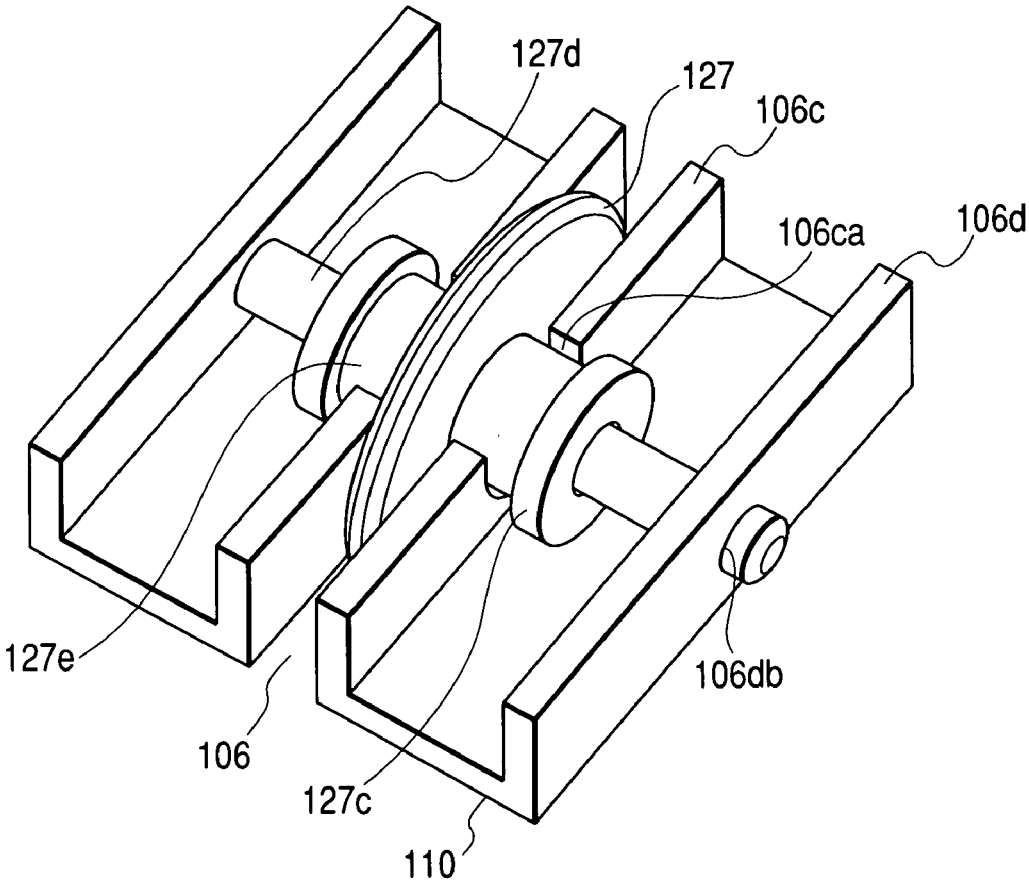
FIG. 19 is a perspective view showing the roller 127 and its neighborhood according to the modification example of the invention, as viewed from the lower side.

Modification examples for preventing the ink from flowing into the sliding portion of the roller 127 will be described below. FIG. 18 is a cross-sectional view showing the roller 127 and its neighborhood according to the modification example of the invention. Also, FIG. 19 is a perspective view showing the roller 127 and its neighborhood according to the modification example of the invention, as viewed from the lower side. In FIGS. 18 and 19, the same or like parts functioning the same operation are designated by the same numerals as in FIGS. 16 and 17.

In FIGS. 18 and 19, the roller 127 projects from the surface of the platen 110 through the through hole 106 defined on the surface of the platen 110. A cylindrical portion 13*e* projects from both sides of the roller 127 in the direction of a rotation axis 127*d*. Moreover, the flange portion 127*c* is provided around the rotation axis 127*d* on both end portions of the cylindrical portion 127*e*. Herein, the roller 127 is rotated separately around the rotation axis 127*d*. At this time, the cylindrical portion 127.e serves as the beating portion rotating around the rotation axis 127*d*. The rotation axis 127*d* may be fixed without itself rotating.

On the other hand, the ribs 106*c* protrude from the rear face of the platen 110 near the through hole 106 on both sides in the direction of the rotation axis 127*d*. Each rib 106 defines the notch 106*ca* of the semicircular shape as viewed axially. The ribs 106*c* surround the cylindrical portion 127*e*. Also, each rib 106*d* extends from the rear face of the platen 110 towards both ends of the rotation axis 127*d* and defines a bore 106*db* through which the rotation axis 13*d* is fitted.

In this configuration, even if the ink permeates through the through hole 106, the rib 106*c* and the flange portion 127*c* function as an ink prevention wall, so that the ink remains on the surface of the cylindrical portion 127*e* or drips therefrom. As a result, the ink don't reach the bearing portion including an inner circumferential wall 127*ea* of the cylindrical portion 127*e*, which serves as the sliding portion. Thereby, it does not occur that the ink flows into the sliding portion and is fixed to impair the roller 127 from being rotated, resulting in a greater transporting load than when the roller 127 is rotated.

Various modification examples for preventing the ink from flowing into the sliding portion of the roller 127 will be described below. FIG. 20 is a cross-sectional view showing the roller 127 and its neighborhood according to the various modification examples of the invention. FIG. 20A is an example in which the roller 127 has a function of the ink prevention wall. Herein, two flange portions 127*c* are provided on each sides of the roller 127 in the direction of the rotation axis 127*a*. Thereby, the rollers 127 has a function of the ink prevention wall, so that the ink is prevented from reaching the bearing portion J on the both sides of the rotation axis 127*a*.

Incidentally, the rib 106*d* extending from the platen 110 and rib 116*a* extending from the bearing plate 116 sandwich the rotation axis 127*a* to form the bearing portion J. Also, a concave portion 116*b* is provided on the bearing plate 116 under the roller 127, thereby the ink is gathered in the concave portion 16*b* so as not to drip. The same things are applied to the following examples.

Figure 20B:
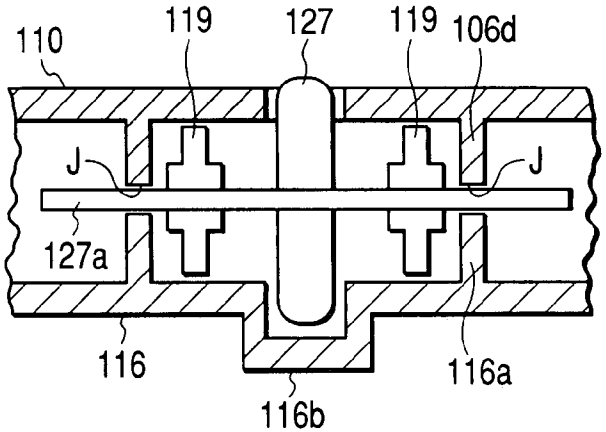
FIG. 20 is a cross-sectional view showing the roller 127 and its neighborhood according to various modification examples of the invention.

FIG. 20B is an example in which rollers 119 different from the roller 127 have a function of the ink prevention wall. Herein, disk-like rollers 19 separate from the roller 127 are provided on both sides of the roller 127 in the direction of the rotation axis 127*a*. Thereby, the rollers 119 function as the ink prevention wall, so that the ink is prevented from reaching the bearing portion J on both sides of the rotation axis 127*a*.

Figure 20D:
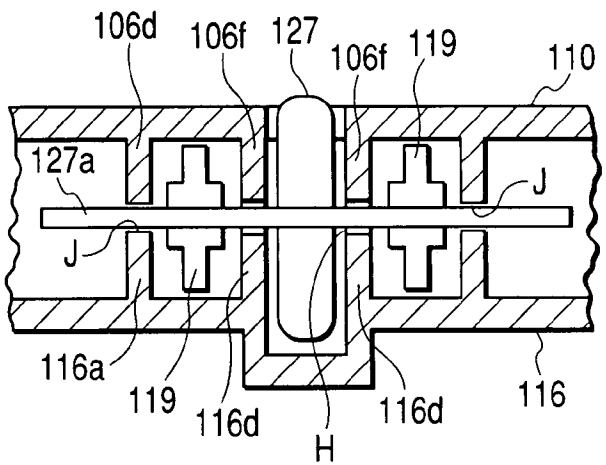
Figure 20A:
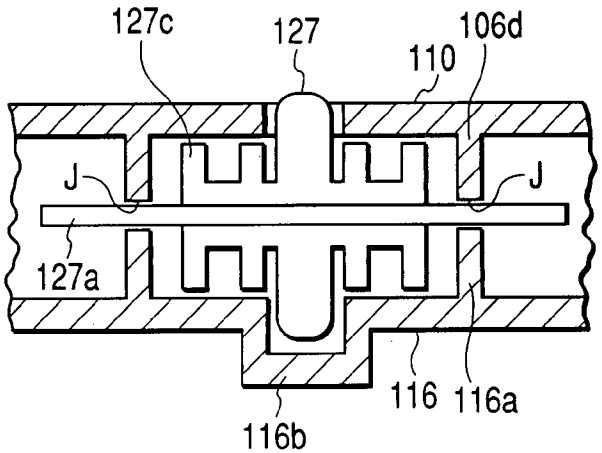
Figure 20C:
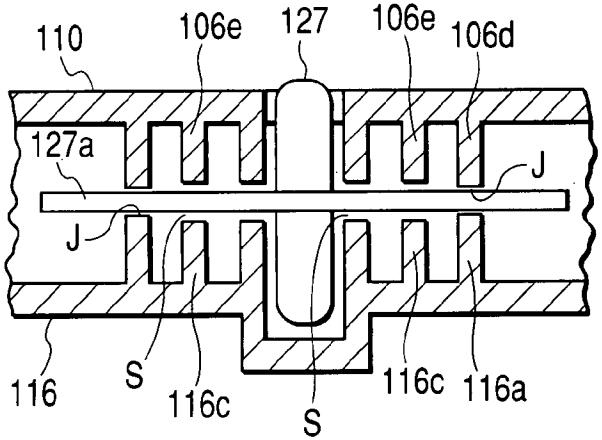

FIG. 20C is an example in which the platen 110 has a function of the ink prevention wall. Herein, two ribs 106*e* extending from the platen 110 and two ribs 116*c* extending from the bearing plate 116 are provided on each side of the roller 127 in the direction of the rotation axis 127*a*, and face each other via the rotation axis 127*a*. A slit S orthogonal to the paper face is formed between the rib 6*e* and the rib 16*c*. This configuration functions as the ink prevention wall, so that the ink is prevented from reaching the bearing portion J on the both side of the rotation axis 127*a*.

FIG. 20D is an example in which the rollers 119 separate from the roller 127 and the platen 110 cooperate to have the function of the ink prevention wall. Herein, two ribs 106*f* extending from the platen 110 and two ribs 116*d* extending from the bearing plate 116 are provided on each side of the roller 127 in the direction of the rotation axis 127*a*, and face each other via the rotation axis 127*a*. A bore H is formed between the rib 106*f* and the rib 116*d*. Moreover, the disk-like rollers 119 separate from the roller 127 are provided coaxially on both sides of the roller 127 in the direction of the rotation axis 127*a* and outside the ribs 106*f*, 116*d*. The ribs 106*f*, 116*d* and the rollers 119 cooperate to function as the ink prevention wall, so that the ink is prevented from reaching the bearing portion J on the both sides of the rotation axis 127*a*.

Figure 21:
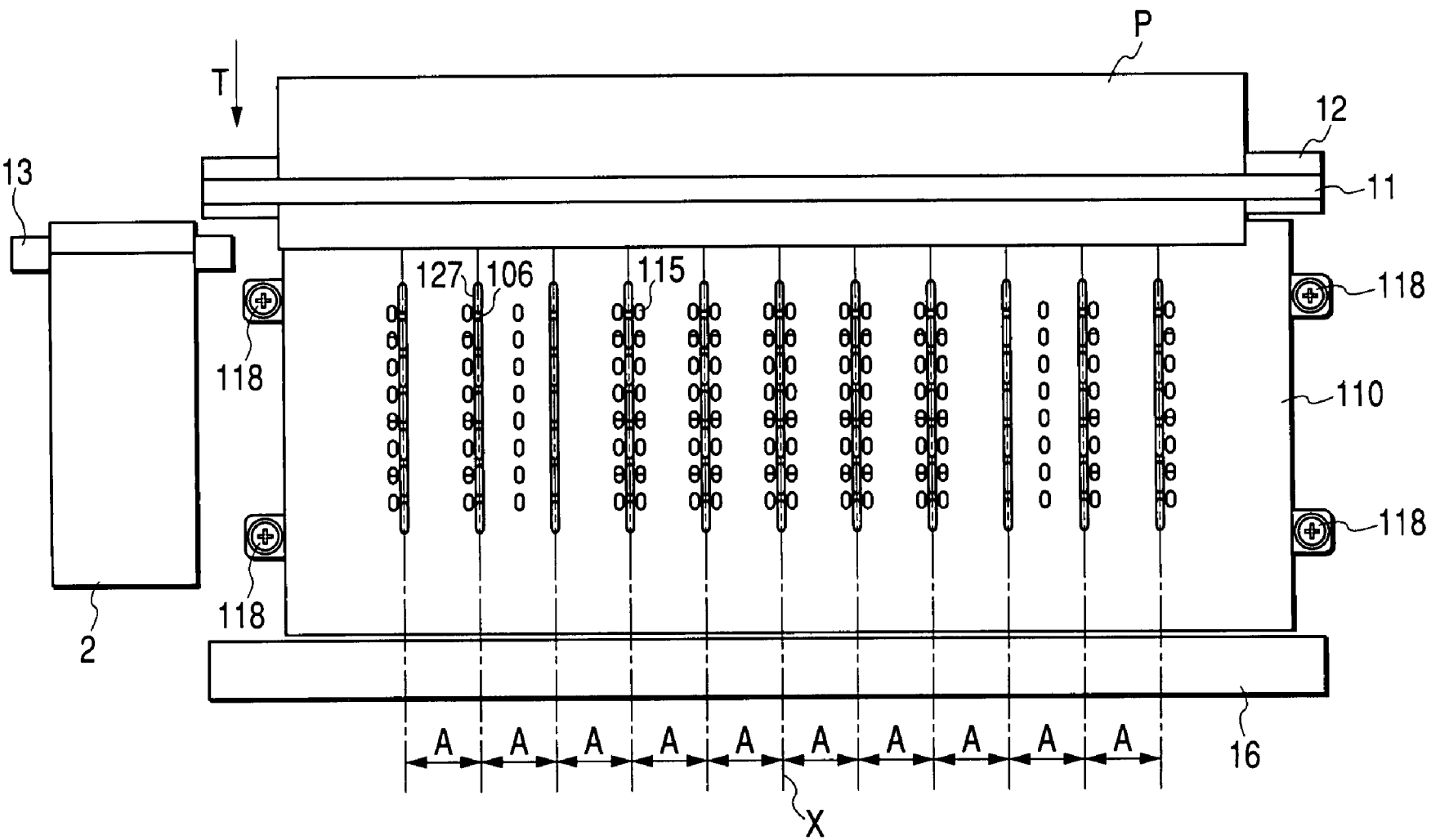
FIG. 21 is a plan view showing a modification example of the platen and its neighborhood.

FIG. 21 is a plan view showing a modification example of the platen and its neighborhood. In FIG. 21, in this modification example, the rollers 127 are disposed in line symmetry about the central line X parallel to the transportation direction T, like the second embodiment as shown in FIG. 15. However, in this modification example, all the pitches between rows of the rollers 127 are equal as indicated by A size in FIG. 21. This configuration may be effective depending on the paper P to be dealt with. In FIG. 21, the outgoing lines for the rollers 127 and the suction openings 115 are only partly illustrated.

In this embodiment, it is supposed that the rotation axes of the rollers 127 are parallel to the surface of the platen 110, but not limited thereto. The rotation axes of the rollers 127 may be inclined with respect to the surface of the platen 110, so long as the rollers 127 are rotated along the transportation direction of the paper. Also, the shape of the rollers 127 is not limited to the column or disk as in this embodiment, but may be sphere or truncated cone, so long as the roller 127.is a rotation body.

Also, the rollers 127 are attached from the rear face (lower side) of the platen 110, but may be attached from the front face (upper side) of the platen 110. Also, the rollers 127 are rotated as the paper P is transported, but may be positively rotated by a motor.

Moreover, in this embodiment, all the rollers 127 can be rotated separately, but some of rollers 127 may be rotated separately.

Besides, in the embodiments, the invention is applied to the image forming apparatus for ejecting liquid ink onto the paper, but may be applied to an image forming apparatus for fixing powder toner onto the paper.

It should be understood that the invention is not limited to the above-described embodiments. The first and second embodiments may be combined desirably so long as such combination does not impair the gist of the invention. Also, the invention can be modified variously within a range of the gist of the invention.

What is claimed is:

1. An image forming apparatus comprising:

an image forming unit which forms an image on one surface of a printing medium;

a platen;

a transporting device which transports the printing medium in a transportation direction along the platen while the other surface of the printing medium faces a surface of the platen; and a suction device which sucks air, wherein:

the platen includes:

a plurality of rollers which are rotatable around rotation axes perpendicular to the transportation direction and protrude from the surface of the platen, wherein at least a part of the rollers rotate independently from each other; and a suction opening which is defined on the surface of the platen and communicates with the suction device.

2. The image forming apparatus according to claim 1, wherein the rollers are arranged in the transportation direction.

3. The image forming apparatus according to claim 1, wherein:

the rollers are arranged in the transportation direction; and the rollers form a plurality of rows of the rollers.

4. The image forming apparatus according to claim 3, wherein the suction opening is defined on the surface of the platen and between the rows of the rollers.

5. The image forming apparatus according to claim 1, wherein the suction opening is defined on the surface of the platen and in the vicinity of at least one of the rollers.

6. The image forming apparatus according to claim 1, wherein the suction opening is defined on the surface of the platen and in the vicinity of an outside of the rollers in a direction perpendicular to the transportation direction.

7. The image forming apparatus according to claim 1, wherein at least a part of the rollers are disposed symmetrically with respect to a predetermined line.

8. The image forming apparatus according to claim 7, wherein a widening ratio of a width between the adjacent rollers is smaller as approaching from a center of the printing-medium carriage to an end portion the printing-medium carriage in the direction perpendicular to the transportation direction.

9. The image forming apparatus according to claim 1, the rollers are arranged at constant intervals in a direction perpendicular to the transportation direction.

10. The image forming apparatus according to claim 1, wherein:

each roller has a radium equal to or larger than 4.3 mm; and a projection amount of each roller from the surface of the platen is equal to or lower than 0.4 mm.

11. The image forming apparatus according to claim 1, wherein:

the image forming unit includes a recording head;

a distance between the printing medium along the surface of the platen and the surface of the platen is equal to or lower than 1 mm; and a projection amount of each roller from the surface of the platen is equal to or lower than 2 mm.

12. The image forming apparatus according to claim 1, wherein a load which the printing medium applies to the rollers is equal to or lower than 0.098 N.

13. The image forming apparatus according to claim 1, wherein:

a flatness of the printing medium is equal to or lower than 0.1 mm, when the printing medium is in contact with the rollers;

the flatness of the printing medium is defined as $$(\text{average distribution negative pressure})\times(\text{pitch between the rollers})^4/(\text{Clark rigidity}).$$

14. The image forming apparatus according to claim 1, wherein tops of the rollers are in a range of 0.1 mm.

15. The image forming apparatus according to claim 1, the rollers are arranged at constant intervals in the transportation direction.

16. The image forming apparatus according to claim 1, further comprising:

bearing members for the rollers; and a prevention member which prevents an image formation agent from adhering to or approaching the bearing member of at least one of the rollers.

17. The image forming apparatus according to claim 16, wherein the prevention member includes a projection portion which projects from the at least one of the rollers in a rotation radius direction.

18. The image forming apparatus according to claim 17, wherein the at least one of the rollers and the projection portion are formed integrally.

19. The image forming apparatus according to claim 16, wherein:

the prevention member includes:

a first projection portion which projects from the at least one of the rollers in a rotation radius direction; and a second projection portion from the at least one of the rollers, in parallel to the first projection portion.

20. The image forming apparatus according to claim 19, wherein the at least one of the rollers, the first projection portion, and the second projection portion are formed integrally.

21. The image forming apparatus according to claim 16, wherein the prevention member includes a projection portion which is integrally formed with the platen and projects from the platen.

22. An image forming apparatus comprising:

an image forming unit which forms an image on one surface of a printing medium;

a platen;

a transporting device which transports the printing medium in a transportation direction along the platen while the other surface of the printing medium faces a surface of the platen; and a suction device which sucks air, wherein:

the platen includes:

a plurality of rollers which are rotatable around rotation axes perpendicular to the transportation direction and protrude from the surface of the platen;

a suction opening which is defined on the surface of the platen and communicates with the suction device;

a plurality of rib portions which protrude from the surface of the platen, extend in parallel to the transportation direction, and are arranged in a direction perpendicular to the transportation direction at a predetermined interval; and an air flow passage which is defined between the adjacent rib portions, extends in the transportation direction, and includes the suction opening;

the rollers are disposed in at least one of the rib portions and the air flow passage; and a part of each roller protrudes to be closer to a printing-medium side than each rib portion.

23. The image forming apparatus according to claim 22, wherein the air flow passages includes the suction opening on at least one of upstream and downstream, in the transportation direction, of an image forming area where the image forming unit forms the image.

24. The image forming apparatus according to claim 23, wherein:

the suction opening is a plurality of suction openings; and the air flow passages includes the suction openings on the upstream and downstream, in the transportation direction, of the image forming area, the image forming apparatus further comprising:

an air chamber which communicates the suction openings on the upstream and downstream of the image forming area.

25. The image forming apparatus according to claim 24, wherein a total area of the suction openings on the upstream of the image forming area is equal to that on the downstream of the image forming area.

26. The image forming apparatus according to claim 22, wherein:

the platen further includes convex portions which extend in the direction perpendicular to the transportation direction, are connected to or adjacent to at least the two adjacent rib portions, and are disposed on upstream and downstream, in the transportation direction, of an image forming area where the image forming unit forms the image, respectively; and the suction opening is defined at least in a predetermined region in the vicinity of the convex portions.

27. The image forming apparatus according to claim 22, wherein:

the image forming unit includes a recording head having a nozzle face which faces the platen and ejects ink therefrom; and the suction opening is defined on at least one of upstream and downstream, in the transportation direction, of a region where the nozzle face faces the platen.

28. The image forming apparatus according to claim 27, further comprising:

a carriage which moves the recording head forward and backward in a predetermined direction, wherein:

the suction opening is defined outside a region where the carriage has the substantially same height as the nozzle face of the recording head.

29. The image forming apparatus according to claim 28, wherein air flow rate between the surface of the printing-medium carriage and the nozzle face is equal to or lower than 10% of an ink ejection velocity.

30. The image forming apparatus according to claim 29, wherein:

the roller has a radium equal to or larger than 4.3 mm; and a projection amount of the roller from an upper end of each rib portion is equal to or lower than 0.4 mm.

31. The image forming apparatus according to claim 22, wherein:

the image forming unit includes a recording head having a nozzle face which faces the platen; and the suction opening is defined on at least one of upstream and downstream, in the transportation direction, of a region where the recording head faces the platen.

32. The image forming apparatus according to claim 31, further comprising:

a carriage which moves the recording head forward and backward in a predetermined direction, wherein:

the suction opening is defined outside a region where the carriage moves.

33. The image forming apparatus according to claim 31, wherein air flow rate between the surface of the printing-medium carriage and the nozzle face is equal to or lower than 10% of an ink ejection velocity.

34. The image forming apparatus according to claim 33, wherein:

the roller has a radium equal to or larger than 4.3 mm; and a projection amount of the roller from an upper end of each rib portion is equal to or lower than 0.4 mm.

35. The image forming apparatus according to claim 22, wherein the rollers are arranged in the transportation direction.

36. The image forming apparatus according to claim 35, wherein the rollers are arranged at constant intervals in the transportation direction.

37. The image forming apparatus according to claim 35, wherein the rollers form a plurality of rows of the rollers.

38. The image forming apparatus according to claim 35, wherein at least a part of the rollers are arranged symmetrically with respect to a virtual line extending in the transportation direction.

39. The image forming apparatus according to claim 22, wherein:

the rollers form a plurality of rows of the rollers;

the rows of the rollers are arranged in the direction perpendicular to the transportation direction at predetermined intervals; and the predetermined intervals widen as approaching from a center of the printing-medium carriage to an end portion the printing-medium carriage in the direction perpendicular to the transportation direction.

40. The image forming apparatus according to claim 22, wherein the rib portions extend in the transportation direction continuously or not-continuously.

41. A platen comprising:

a plurality of rib portions which protrude from a surface of the platen, extend in parallel to a transportation direction of a printing medium, and are arranged in a direction perpendicular to the transportation direction at a predetermined interval;

an air flow passage which is defined between the adjacent rib portions, and extends in the transportation direction;

a plurality of rollers which are disposed in at least one of the rib portions and the air flow passage; and a suction opening which is defined on the surface of the platen in the air flow passage, wherein:

a part of each roller protrudes to be closer to a printing-medium side than each rib portion.

42. The platen according to claim 41, wherein the rib portions extend in the transportation direction continuously or not-continuously.

* * * * *